US009669287B2

(12) United States Patent
Domingo

(10) Patent No.: US 9,669,287 B2
(45) Date of Patent: Jun. 6, 2017

(54) UNIVERSAL SPEED CONTROL SYSTEM FOR A WHEELED BOARD CONVEYANCE

(71) Applicant: Nicanor A. Domingo, Santa Clara, CA (US)

(72) Inventor: Nicanor A. Domingo, Santa Clara, CA (US)

( * ) Notice: Subject to any disclaimer, the term of this patent is extended or adjusted under 35 U.S.C. 154(b) by 0 days.

(21) Appl. No.: 15/052,550

(22) Filed: Feb. 24, 2016

(65) Prior Publication Data

US 2016/0271484 A1 Sep. 22, 2016

Related U.S. Application Data

(60) Provisional application No. 62/120,868, filed on Feb. 25, 2015.

(51) Int. Cl.
*A63C 17/14* (2006.01)
*A63C 17/01* (2006.01)

(52) U.S. Cl.
CPC ..... *A63C 17/1418* (2013.01); *A63C 17/012* (2013.01); *A63C 17/015* (2013.01); *A63C 2017/1463* (2013.01)

(58) Field of Classification Search
CPC ..... A63C 17/1409; A63C 17/1418; A63C 17/012; A63C 17/015; A63C 2017/1463
See application file for complete search history.

(56) References Cited

U.S. PATENT DOCUMENTS 3,288,251 A * 11/1966 Sakwa ..... A63C 17/01 188/29
3,385,608 A * 5/1968 Waddell ..... A63C 17/01 188/167
3,945,655 A * 3/1976 Banks ..... A63C 17/01 188/2 R
4,003,582 A * 1/1977 Maurer ..... A63C 17/01 188/2 R
4,027,890 A * 6/1977 Volkmann ..... A63C 17/01 188/2 R
4,037,852 A * 7/1977 Bayer ..... A63C 17/01 188/29
4,055,234 A * 10/1977 Burton ..... A63C 17/01 188/19
4,084,831 A * 4/1978 Akonteh ..... A63C 17/01 188/29
4,094,524 A * 6/1978 Carroll ..... A63C 17/01 188/29
4,166,519 A 9/1979 Maloney
5,915,707 A * 6/1999 Steffen ..... A63C 17/0026 280/87.01
6,213,484 B1 * 4/2001 Rohner ..... A63C 17/01 280/87.042
6,659,480 B1 12/2003 Newman (Continued)

FOREIGN PATENT DOCUMENTS

AU WO9215378 * 9/1992 ..... A63C 17/14
ES WO 2009092831 A1 * 7/2009 ..... A63C 17/1418
TW GB 2360559 A * 9/2001 ..... B60T 1/04

*Primary Examiner* — Hau Phan
*Assistant Examiner* — Jacob Meyer
(74) *Attorney, Agent, or Firm* — Levine Bagade Han LLP

(57) ABSTRACT

A braking system for a wheeled apparatus and an improved wheeled apparatus, such as a skateboard, are described where the braking system allows for easy, quick and universal mounting onto the deck of a typical board.

20 Claims, 21 Drawing Sheets

(56) References Cited

U.S. PATENT DOCUMENTS

| | | | | |
|---|---|---|---|---|
| 6,820,881 | B1 * | 11/2004 | Berry | A63C 17/01 180/20 |
| 8,371,594 | B2 * | 2/2013 | Palmer | A63C 17/01 280/11.215 |
| 8,522,928 | B2 * | 9/2013 | Orcutt | B60T 1/14 188/5 |
| 9,504,902 | B1 * | 11/2016 | Johnson | A63C 17/14 |
| 9,504,903 | B2 * | 11/2016 | Newman | A63C 17/1427 |
| 9,522,320 | B1 * | 12/2016 | McDowell | A63C 17/1418 |
| 2006/0108753 | A1 * | 5/2006 | Harnden | A63C 17/01 280/11.27 |
| 2014/0091547 | A1 * | 4/2014 | Storm | A63C 17/015 280/87.042 |

* cited by examiner

Figure 17

| Braking Stage | State of Actuation from Rider Input | Braking Surface Contacting Wheels | Compression of Force Transmission Spring | Amount of Braking Force |
|---|---|---|---|---|
| Stage 0 | Zero Actuation | Not Contacting | Zero | Zero |
| Stage 1 | Partial Actuation | Contacting | Adjustable per Rider Preference | Adjustable per Rider Preference |
| Stage 2 | Maximum Actuation | Contacting | Maximum, Actuator Shell Directly Contacting Brake Arm | Maximum |

Figure 18

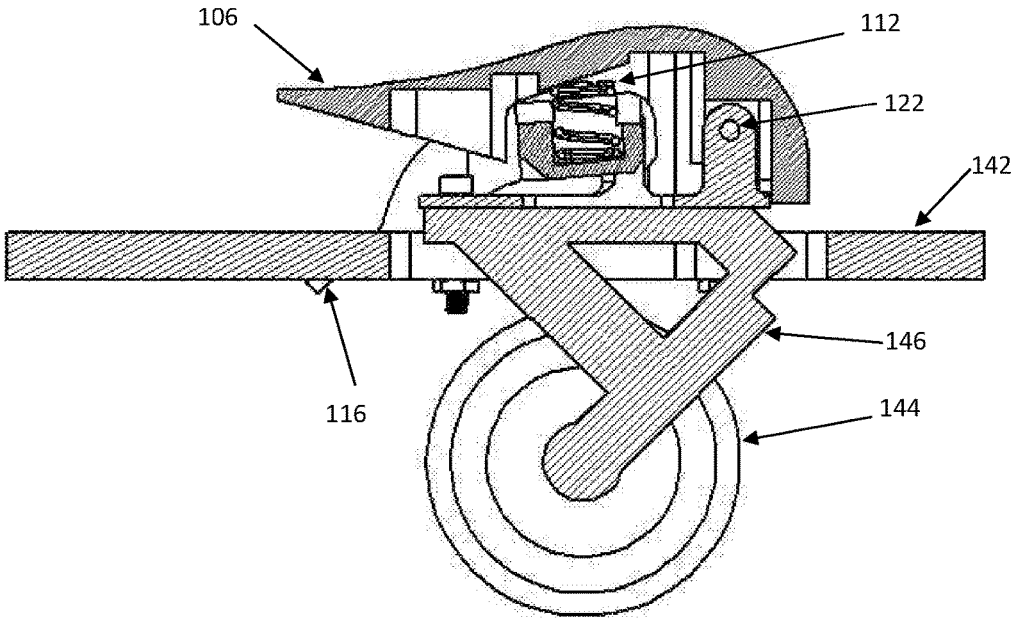

UNIVERSAL SPEED CONTROL SYSTEM FOR A WHEELED BOARD CONVEYANCE

FIELD OF THE INVENTION

This is a non-provisional application of U.S. Provisional Application No. 62/120,868 filed on Feb. 25, 2015, the entirety of which is incorporated by reference.

FIELD OF THE INVENTION

Described herein are systems, devices and methods for slowing and stopping a wheeled apparatus, especially a skate board or longboard. More specifically, a variations of the braking system can be added to many conventional standard longboards without permanent modification to the board and without switching out any of the board's stock or as-bought components.

BACKGROUND

In the foregoing descriptions, the various embodiments describe brake systems for any wheeled apparatus, especially such devices that include a board and truck system. However it should be noted that this is for exemplary reasons only and the invention applies to other wheeled board conveyances such as scooters, skate boards, and other such conveyances. Conventional brakes can be discussed in three basic categories: (1) street friction (force applied to the street or ground), (2) tire friction (force applied directly to the tire portion of the wheel), and (3) wheel friction (force applied to the inner hub of the wheel or to the axle).

Street friction brakes, such as that described in U.S. Pat. No. 8,522,928 (Orcutt) and such as the commercially available POGO Brake from Germany, are inherently noisy and cause a bumpy, unstable and potentially unsafe braking action.

The second type of system, inner wheel hub or axle friction systems and can provide effective, smooth and safe braking action. However, these systems have the significant disadvantage that they are relatively expensive and specialized because they are integrated into the design and construction of the axle assembly, known as the truck assembly, and sometimes the board part of the longboard, known as the deck. The majority of users do not want to be forced into paying for the extra expense of these more expensive systems. Moreover, the majority of users prefer to choose a truck assembly and deck of their liking, not a design that is dictated by the company selling the brake. An example is the commercially available Brakeboard (www.brakeboard-.com).

The third brake system category, that of a tire friction system. Namely, a braking system that applies friction to the wheel or tire of the device. Other tire friction are known but have experienced little to no adoption in the marketplace. For example, a tire friction braking system is described in U.S. Pat. No. 3,288,251 (Sakwa). However, the Sakwa system requires that the rider position their rear foot over the rear truck, during braking. Such a placement is contrary to a conventional rider stance on a longboard where a rider positions the feet in between the trucks for stability. Moving the feet over or behind the truck can be a less stable riding position on a longboard. The Sakwa device also requires permanent modification to the existing skateboard and makes as more complicated and difficult. Sakwa's swivel housing mates with the truck. However, trucks vary in geometry so Sakwa's structure may not be universal with all trucks. Sakwa does not offer a large range of braking pressure on the wheels. The Sakwa system is comprised of only rigid components and only provides direct force transmission compared to the present invention which provides a dual stage braking capability giving the rider a larger range of braking force.

U.S. Pat. No. 3,945,655 (Banks) also describes a tire friction braking system. Banks's actuation pedal is in the front which encourages a shift of weight toward the front during braking. During deceleration, weight of the rider is already biased forward and should be counteracted toward the rear in order to prevent toppling over. Again, this is a different riding position as compared to a conventional rider stance of a longboard which positions the feet in between the trucks for stability. Banks requires the rider to position their rear foot over the front truck, during braking, which is sub-optimal for riding. It is a less stable riding position on a longboard. Banks requires permanent modification of the deck and the rear truck. In Banks, at no point during the braking process can the rider provide direct pressure on to the wheels. The cable is always in between the rider and the wheels and the cable can stretch.

U.S. Pat. No. 4,003,582 (Maurer) also describes a tire friction braking system which has the following challenges: (1) The conventional rider stance of a longboard positions the feet in between the trucks for stability whereas Maurer requires the rider to position their rear foot over the rear truck, during braking, which is sub-optimal for riding. It is a less stable riding position on a longboard; (2) Maurer requires permanent modification to the existing skateboard is required; (3) Maurer's brake does not pivot with the truck assembly during turning, which makes it difficult to provide adequate wheel clearance for turning; (4) In Maurer, at no point during the braking process can the rider provide direct pressure on to the wheels. A flexible element is always in between the rider and the wheels.

U.S. Pat. No. 4,094,524 (Carroll) also describes a tire friction braking system Again, Carroll requires the rider to position their foot off-center which is inherently less stable than a centered more balanced foot position. Carroll's device further compromises stability because the required foot position during braking is much higher off of the deck. Typically, a rider's foot should remain close to the deck to promote stability. The higher the rider lifts their foot off of the deck, the more unstable the riding position becomes. Caroll's device requires a rider to raise their foot a distance off of the deck because the stroke required to actuate the braking system is significant because the brake pads are set-off far from the wheels in order to prevent interference with the wheels during turning. In Carroll, at no point during the braking process does the brake offer a large range of braking pressure on to the wheels. The Carroll system is comprised of only rigid components and only provides direct force transmission.

U.S. Pat. No. 4,166,519 (Maloney) also describes a tire friction brake system, that requires permanent modification of the deck. Again, the device of Maloney requires the rider to position their foot off-center which is inherently less stable than a centered more balanced foot position. Maloney does not have the advantages of a dual stage braking system.

Another tire friction brake system previously available commercially is known as the V-Brake, includes a system that connects to the side of the board to apply the brake to only one wheel on the side of the board that the system is connected to. This system suffers from poor human factors design and ergonomics as it is difficult to maintain one's balance when used.

Another tire friction brake system available commercially is known as the Talon. This system is an advanced engineered system and requires a proprietary board, truck and wheels. This proprietary nature of the system makes it un-deployable to a mass market for reasons described previously. Another tire friction brake system available commercially is known as the Brakeboard. This system also requires a proprietary truck and wheels.

Another way to categorize brakes is between those that are hand actuated, and those that are foot actuated. Hand actuated brakes may work like a bicycle brake, for example they may use a hand operated lever, attached via a cable to a brake shoe witch impinges on the wheel or tire. However, in this case there is an extra cable that can be an inconvenience to the rider especially when not in use.

When opting for a braking system, a user will benefit if they have the choice of combining the braking system with a variety of decks, trucks, and/or wheel types.

In 2013 there were 21 skateboard fatalities in the United States, most of which occurred on public streets, and based on a recent study approximately 16,000 unpowered skate board related traumatic brain injuries per year. Most of these fatalities and injuries are with children, and at a significant social cost and healthcare utilization cost to the country. These statistics and the limitations of the prior art systems aforementioned, clearly point out a dire and unmet need for a brake system is improved over the conventional brake systems. Specifically, a successful tire braking system would include one or more of the following attributes (but is not limited to the attributes): (1) smooth and quite operation; (2) simple, quick, reliable, consistent, predicable and safe assembly; (3) assembly without requiring any modifications nor requiring substituting the stock or as-bought components such as the deck, truck and wheels, with special components, and such that deployment can be easily manageable in the retail or home setting; (4) easy, quick and safe disassembly; (5) low cost; (6) universally install-able on all standard longboard decks, trucks and wheels; (7) allows the rider to position their feet the way they would normally position their feet for maintaining balance and normal riding throughout the different stages of slowing and braking; (8) braking can be applied to both the left and right wheel; (9) a large braking range with a range of different force levels capable of being applied.

The present invention provides an improved brake system to encourage widespread adoption of a brake that meets the riders' requirement as well as allows for ease of installation across multiple boards, trucks, and or wheels.

SUMMARY

The illustrations and variations described herein are meant to provide examples of the methods and devices of the invention. It is contemplated that combinations of aspects of specific embodiments or combinations of the specific embodiments themselves are within the scope of this disclosure.

The present disclosure provides for an improved brake system for a wheeled riding apparatus or an apparatus having an improved brake system disclosed herein. The apparatus can comprise a skate board, a long board, or any wheeled riding apparatus that includes a deck for riding and a truck affixed thereto as well as one or more wheels coupled to the truck.

In one example brakes system is for use with a riding apparatus having a deck with at least one truck coupled to a bottom of the deck through a plurality of mounting holes in the deck, and at least one wheel mounted to the truck, the brake system comprising: a base structure having a plurality of fastener openings corresponding to at least one of the plurality of mounting holes, the base mountable on a top of the deck to the at least one truck through at least one of the plurality of mounting holes; a brake arm having a center section and a first lateral section with a first brake surface, the center section pivotably coupled to the base structure and the first lateral section extending over a first edge of the deck such that the brake surface is positioned adjacent to at least one wheel; a brake lever pivotally coupled to the base structure and the brake arm; and a force transmitting component coupled between the brake arm and brake lever, where the force transmitting component is resilient and compressible such that the force transmitting component maintains the brake lever in a disengaged state and application of a force to the brake lever causes the force transmitting component to transfer a portion of the force to the brake arm to move the brake surface towards the at least one wheel until the brake surface engages the at least one wheel.

In another variation, the brake system can include a base structure having a plurality of fastener opening corresponding to at least one of the plurality of mounting holes, the base structure mountable on a top of the deck to the at least one truck through at least one of the plurality of mounting holes; a brake arm having a center section and a first lateral section with a first brake surface, the center section pivotably coupled to the base structure and the first lateral section extending over a first edge of the deck such that the brake surface is positioned adjacent to at least one wheel; a brake lever coupled to both the base structure and the brake arm such that the brake surface is in maintained in a separated state from the at least one wheel, and upon application of a force to the brake lever causes the brake lever to move the brake surface towards the at least one wheel until the brake surface engages the at least one wheel; and where the brake lever comprises at least one access opening to permit access to the fastener openings to permit disengagement of the base structure, brake arm, and brake lever from the at least one truck.

The brake systems described herein can include variations where a center of the brake lever is aligned with a center of the base structure such that when affixed to the deck, the center of the brake lever is aligned with a center lengthwise axis of the deck.

In additional variations, the brake arm further comprises a second lateral section with a second brake surface, where the second lateral section extends opposite to the first lateral section such that the second brake surface is positioned adjacent to at least a second wheel.

The force transmitting component can comprise a maximum compressed state, such movement of the brake lever to cause the force transmitting component to reach the maximum compressed state causes the force transmitting component to fully transfer the force applied to the brake arm.

In variations, the brake lever and brake arm are separately pivotally coupled to the base structure. Such a configuration allows for variations of the system where the brake lever and brake arm are configured such that an angular displacement of the brake lever produces an angular displacement of the brake arm, where the angular displacement of the brake arm is greater than the angular displacement of the brake lever.

In additional variations, the brake system can further include a cam surface on the brake lever, where the cam surface engages the force transmitting component and amplifies a travel distance of the brake surface caused movement of the brake lever.

Variations of the brake system of further include a spring member coupling the brake arm and the base structure to return the brake lever and brake arm to the disengaged state upon removal of the force from the brake lever.

The brake systems described herein can be designed such that the plurality of mounting holes on the base structure are configured to match a truck mounting holes of an industry common board.

The force transmitting structure can comprise a compression spring, shock absorber, or other spring mechanism. In certain variations, the compression spring comprises a variable force to apply a variable breaking force on the brake surface to the wheel, wherein the greater the compression the greater the force.

The brake system can also include a compressible member coupled to the brake arm configured to reduce vibration of the brake arm.

In another variation, the invention includes a wheeled riding apparatus comprising: a deck having a top surface configured for riding by a user, a bottom surface, and a plurality of mounting holes extending through the deck; at least one truck having at least one wheel mounted to the truck, the at least one truck located on the bottom surface of the deck; a brake system comprising a base structure, a brake arm, and a brake lever, the base structure having a plurality of fastener openings corresponding to at least one of the plurality of mounting holes, the base mountable on the top of the deck and secured to the at least one truck through at least one of the plurality of mounting holes; a brake arm having a center section and a first lateral section with a first brake surface, the center section pivotably coupled to the base structure and the first lateral section extending over a first edge of the deck such that the brake surface is positioned adjacent to at least one wheel; a brake lever pivotally coupled to the base structure and the brake arm; and a force transmitting component coupled between the brake arm and brake lever, where the force transmitting component is resilient and compressible such that the force transmitting component maintains the brake lever in a disengaged state and application of a force to the brake lever causes the force transmitting component to transfer a portion of the force to the brake lever to move the brake surface towards the at least one wheel until the brake surface engages the at least one wheel.

Variations of the wheeled riding apparatus can include a first forward truck and a second rear truck, and where the plurality of mounting holes comprises a plurality of forward mounting holes and a plurality of rear mounting holes, where each wherein the actuator shell is substantially centered on the board deck and adapted to actuate the brake surface against at least one wheel when depressed downward toward the deck.

Variations of the apparatus include a center of the brake lever is aligned with a center of the base structure such that when affixed to the deck, the center of the brake lever is aligned with a center lengthwise axis of the deck.

In additional variations, when in the disengaged state the brake surface is positioned to have clearance from the wheel when the deck is not turned relative to the truck and wherein when the deck is turned relative to the truck, the brake surface maintains clearance away from the wheel.

BRIEF DESCRIPTION OF THE DRAWINGS

Each of the following figures diagrammatically illustrates aspects and variation to better understand the invention. Variation of the invention from the aspects shown in the figures is contemplated.

FIG. 17 is a table summarizing the details of the 2 stage braking system.

FIG. 18 is a close up view of the brake area shown in FIG. 14.

DETAILED DESCRIPTION

The present invention describes a brake system which is foot actuated, is attached to the board with a single attachment, is compatible with existing longboard decks, is compatible with existing longboard wheels, applies brakes to both the left and right wheel, is mounted at or near the centerline of the deck to maintain a balanced foot position on the deck, and includes a duel stage large range adjustable braking stroke and braking force. As will be explained subsequently, these criteria are simultaneously accomplished by unique and novel solutions to the technical challenges.

In the devices described herein, interference between the brake and wheel when the brake is not engaged is prevented, however, the distance between the brake and wheel when the brake is not engaged is kept to a minimum by using a stroke multiplier in the brake actuator mechanism, thereby creating a low-to-the-deck brake foot actuator. This allows the rider in the present invention to not compromise their stable, balanced foot position. The devices described herein also provide a dual stage braking capability giving the rider a larger range of braking force, with a range of increasing force versus stroke in the first stage and a greater direct force in the second stage.

The brake system can be added to the board without modification of the board and without switching out any of the board's components, making it conveniently universal, versatile and affordable. The universality also makes it manageable in the work flow and economics of a retail shop, or for a realistic home installation. The brake system also permits optimal rider balance when using the brake, making it simple and safe to use, and usable by novice to advanced users. The brake system also permits maximal turning without inadvertent brake engagement by virtue of some additional unique aspects of the invention. The invention is especially useful for longboards and is also useful for other types of boards.

Figure 1:
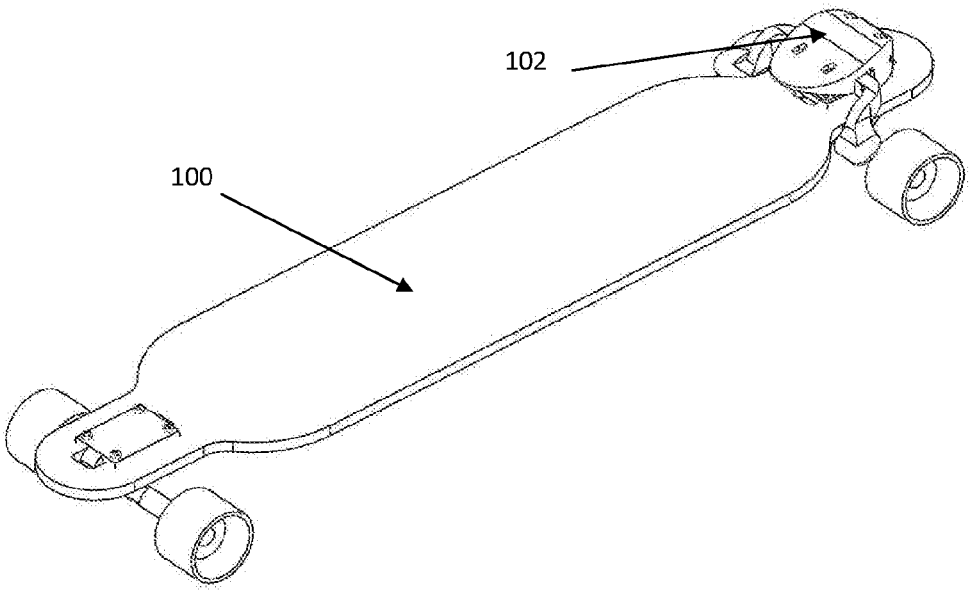
FIG. 1 is an isometric view of a conventional longboard (100) with the brake system (102) described in this invention.

In FIG. 1 a conventional longboard (100) is shown with the brake system (102) described in this invention. The longboard deck (142) shown is a flat deck, although the invention is contemplated to be compatible with a drop deck. The brake assembly (102) is affixed to the rear of the board (100) in the location of the rear truck assembly (146) attachment to the deck (142). The style of the longboard (100) shown is that in which the longboard deck (142) is not above the wheels (144)—the axles extend laterally beyond the sides of the deck (142). This exposes the top of the wheels (144) for the brake assembly (102) brake arm (114) and braking surface (116). However, it is contemplated by this invention that in cases in which the deck (142) is over the wheel (144), the brake arm (114) can be shaped with the necessary bends to reach the wheel (144) under the deck (142). As can be seen the brake assembly (102) is mounted in the center of the board (100) which affords the rider the ability to press on the brake (102) with his or her foot in the center of the board (100). As will be shown in subsequent figures, the brake (102) is uniquely, easily, safely, reliably and universally mountable onto a standard longboard (100), and easily removable. Also as will be shown, the brake (102) uniquely solves the problem of wheel (144) clearance when turning when the brake (102) is not engaged.

Figure 2:
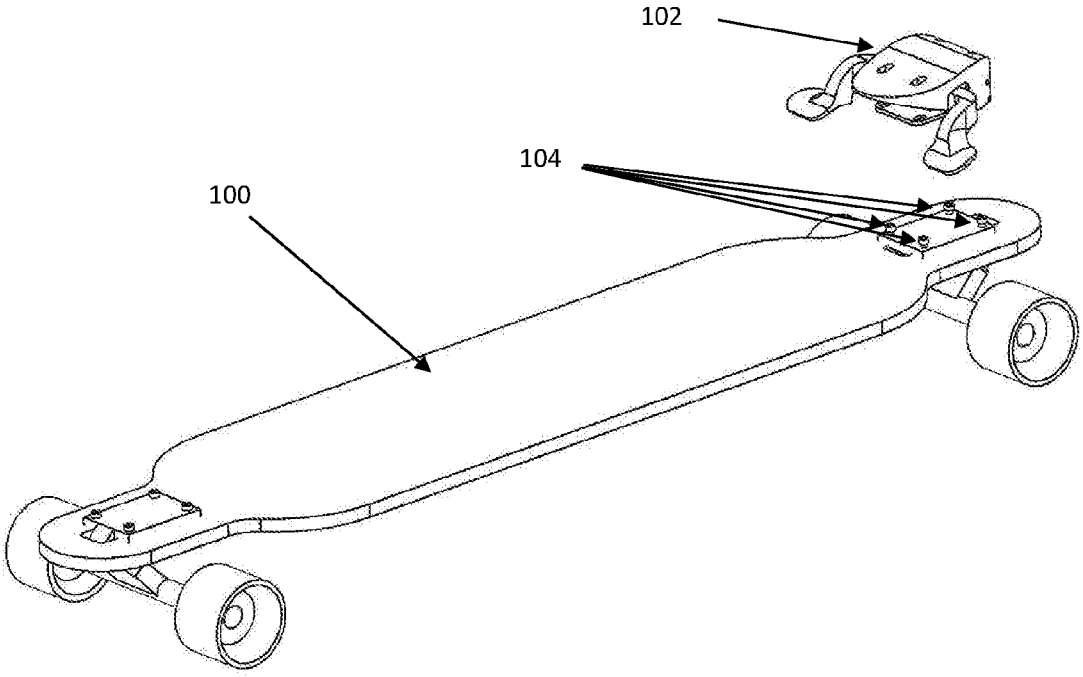
FIG. 2 is an isometric view of the brake system (102) above a conventional longboard (100) illustrating how it is attached.

In FIG. 2, the brake (102) is shown above the longboard (100) with the truck mounting bolts (104) loosened. To assemble the brake (102) to the longboard (100), the truck mounting bolts (104) are loosened but not removed. For convenience, it is not necessary to completely remove the mounting bolts from the longboard (100). The brake (102) can be attached by utilizing a keyhole slot (150) in the base plate (118), and inserting it over the loosened mounting bolts (104), then re-tightening the mounting bolts (104). A close up view of the keyhole slots (150) can be seen in FIG. 12. It should be noted that this mounting method is possible also due to the fact that the keyhole slots (150) match up with the standard bolt-hole pattern used in longboard trucks (144) and decks (142).

Figure 3:
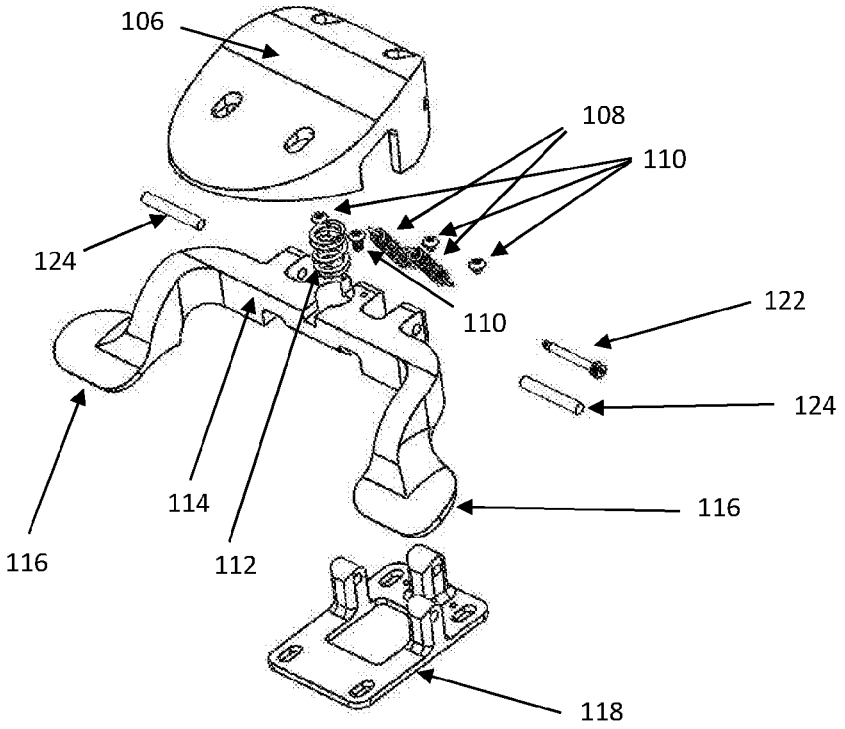
FIG. 3 is an exploded view of the brake system (102) shown in FIG. 1.

In FIG. 3 an exploded view of the brake system (102) is shown. Typically, the brake assembly (102) is provided pre-assembled, with the actuator shell (106), brake arm (114), force transmission spring (112), return spring (108) and base mounting plate (118) joined together in an assembly with the dowel pins (124) attaching the brake arm (114) and a dowel pin or shoulder bolt (122) attaching the actuator shell (106) to the base plate (118) respectively. Optionally, removable, attachable brake pads may be attached to the ends of the brake arm (114). When attaching to the board, the installer simply loosens the existing truck mounting bolts (104), places the brake assembly (102) over the truck plate (146), and attaches the brake assembly (102) to the truck (146) and deck (142) by re-tightening the original truck mounting bolts (104). The base plate or mounting plate (118) has keyhole slots (150) which make it attachable to a standard truck assembly (146). The brake assembly (102) can be easily attached without modification to the board (100), deck (142) or truck assembly (146). Any skate board shop installer, enthusiast or typical user can easily perform this attachment, making widespread commercial deployment of the system possible. The assembly process may take less than five minutes, require only a simple wrench and screwdriver, or similar, and can be therefore performed in a skate shop with negligible overhead costs, making it attractive to a retailer to offer the assembly service free of charge without impacting the shop's profit. In addition, the truck (146), deck (142) or wheels (144) do not have to be changed to a proprietary component in order for the brake assembly (102) to be attached, rendering this invention attractive to the typical consumer. Optionally, an alternative brake base plate adaptor can be provided which mounts to the top of the truck (146) and which includes a quick connect feature to attach the rest of the brake assembly (102) with a very simple attachment such as a spring loaded pin. With this option, an end user can easily remove and attach the brake assembly (102) whenever needed.

Figure 4:
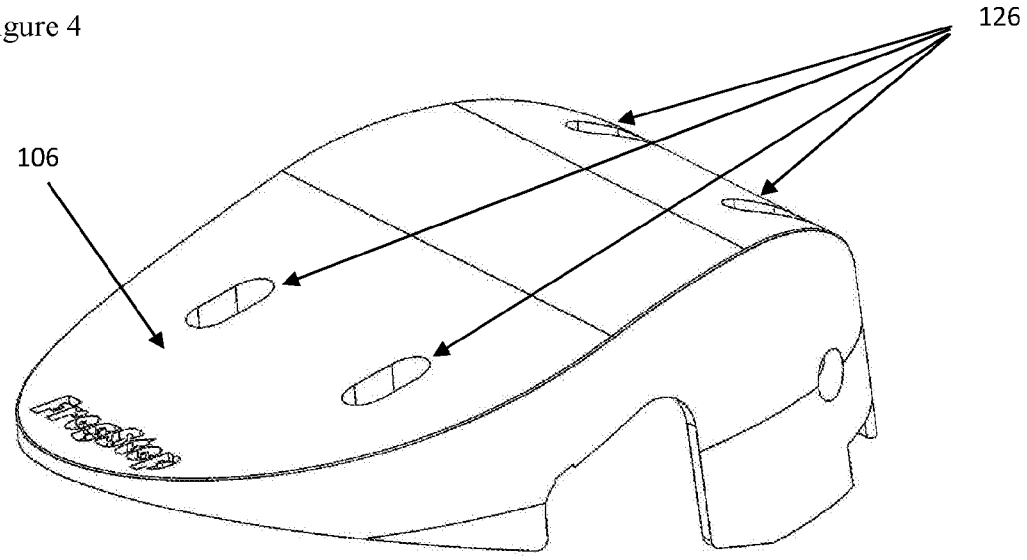
FIG. 4 is a close up isometric top view of the brake actuator shell (106) of the brake in FIGS. 1, 2, and 3.

FIG. 4 is a close up isometric top view of the actuator shell (102) of the brake in FIG. 3. The actuator shell (106) includes slots (126), typically four slots, through which the screwdriver or hex wrench can be inserted to screw the base plate (118) to the truck (146) and deck (142), thereby attaching the brake assembly (102) to the board (100).

Figure 5:
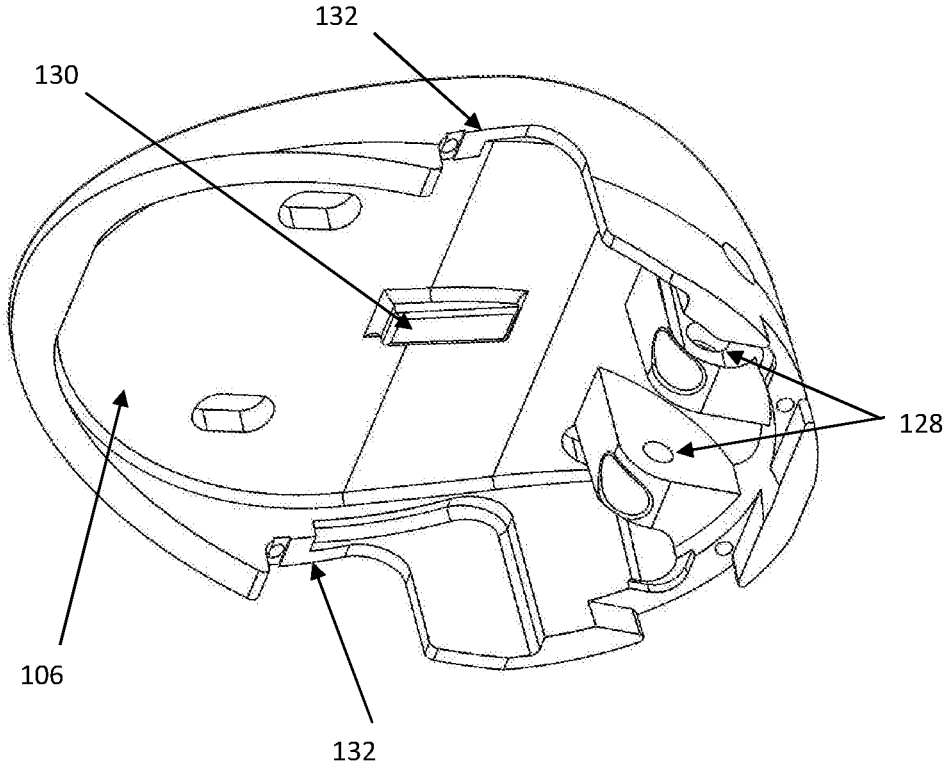
FIG. 5 is a close up isometric bottom view of the brake actuator shell (106) of the brake (102) shown in FIG. 4.

FIG. 5 is a close up isometric bottom view of the actuator shell (106) of the brake (102) shown in FIG. 3. The bottom of the actuator shell (106) includes a cam (130) where the upper end of the force transmission spring (112) is positioned. The left and right side of bottom side of the actuator shell (106) include a notch or contact surface (132) which contacts the brake arm (114) for deflecting the brake arm (114) downward to the wheels (144). In the rear section of the actuator shell (106), pivot holes (128) are shown which line up with the rear pivot holes on the base plate (118), and through which the actuator shell's pivot pins (122) attach the actuator shell (106) to the base plate (118). The distance of the pivot axes, along with the cam (130) and contact surface (132) serve to multiply the stroke angle displacement of the brake arm (114) as will be explained subsequently.

Figure 6:
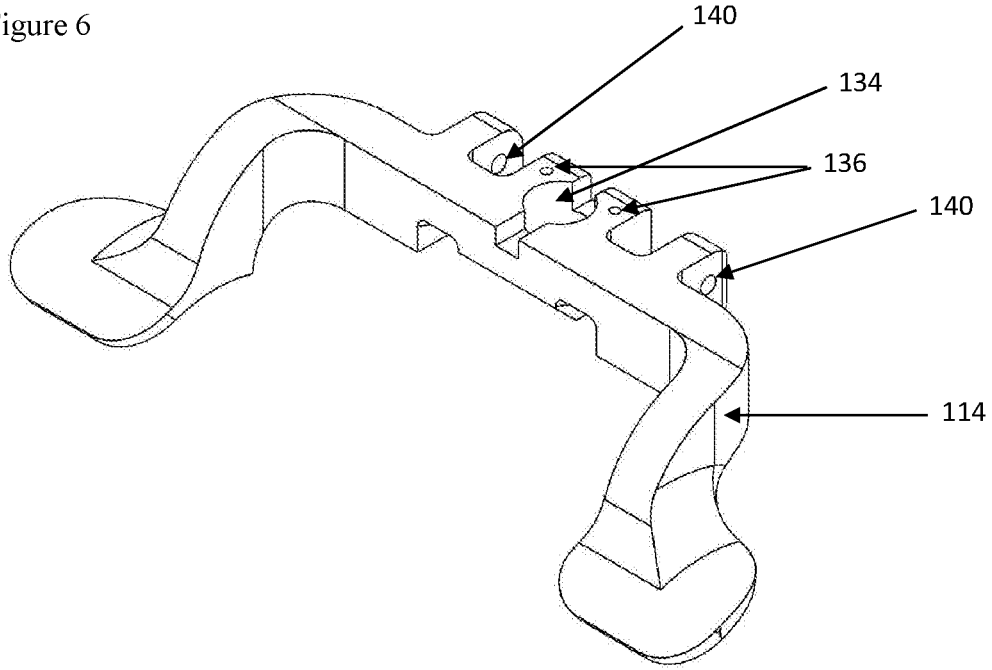
FIG. 6 is an isometric top-side view of the braking arm (114) of the brake system (102) shown in FIG. 1.

FIG. 6 is an isometric top-side view of the braking arm (114) of the brake system (102) shown in FIG. 1. A pocket (134) is provided to position the bottom end of the force transmission spring (112), which is pinched between the actuator shell (106) and brake arm (114). When the actuator shell (106) is depressed downward toward the deck (142), the force transmission spring (112) is compressed, transferring a spring force to the brake arm (114), and thereby pivoting the brake arm (114) downward toward the deck (142) and wheels (144). A mounting feature, such as a mount hole (136) as shown, is included for attachment of a return spring (108) in the rear of the brake arm (114). This return spring (108) is responsible for raising the brake arm (114) and brake surface (116) to their fully up disengaged free state position, which is the position when the brake surface (116) is not depressed to actuate the brake (102). At the lateral ends of the brake arm (114) the brake surfaces (116) can be found, which impinge on the wheel (144) to transmit the slowing and stopping force.

Figure 7:
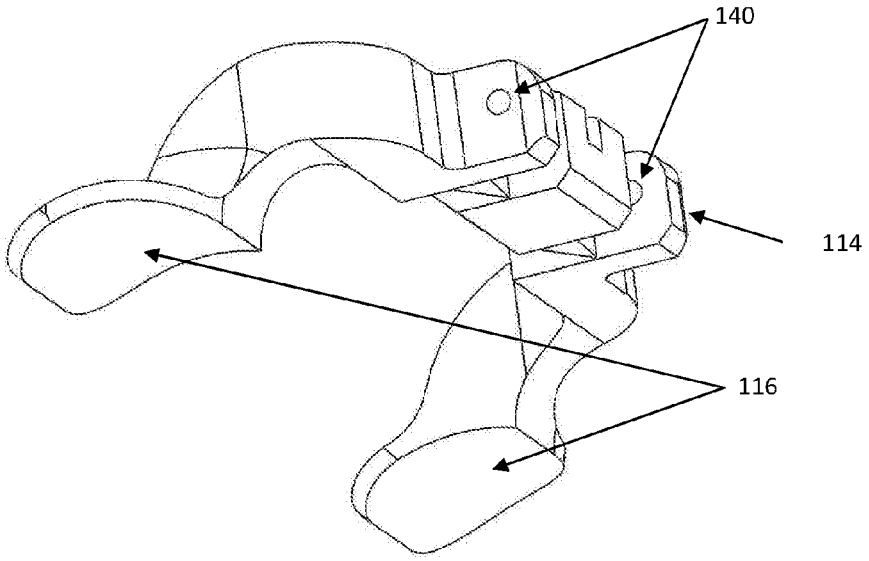
FIG. 7 is an isometric bottom-side view of the braking arm (114) of the brake system (102) shown in FIG. 1.

FIG. 7 is an isometric bottom-side view of the braking arm (114) of the brake system (102) shown in FIG. 1, providing a view of the curved brake surface (116). The anti-binding features such as a rib, rounded surface, lead in feature, groove or rib are not shown for brevity.

FIGS. 8 through 11 show the longboard (100) and brake (102) shown in FIG. 1, with the brake system (102) in its free state, fully disengaged position. As can be seen in a side view in FIG. 7, there is substantial clearance between the brake surface (116) and the wheel (144) when in the disengaged state. As will be explained in the following description, this clearance is exaggerated which is required to allow turning in order for the brake (102) to not make contact with the wheels (144). And, as will also be explained in the following description, in order for this exaggerated clearance to be compatible with a braking motion when braking is desired, a stroke multiplier mechanism has been utilized so as to not require a large actuation motion from the rider. A large actuation motion may lead to instability during riding.

Figure 8:
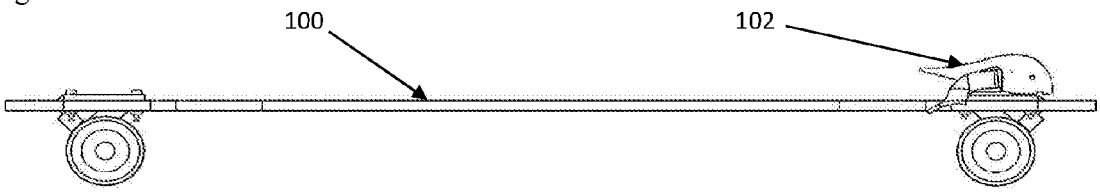
FIG. 8 is a side view of the longboard (100) and brake (102) shown in FIG. 1.
Figure 9:
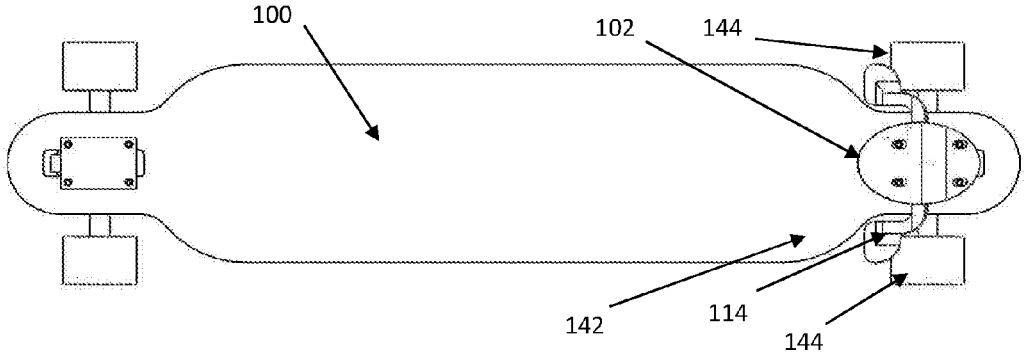
FIG. 9 is a top view of the longboard (100) and brake (102) shown in FIG. 1.
Figure 10:
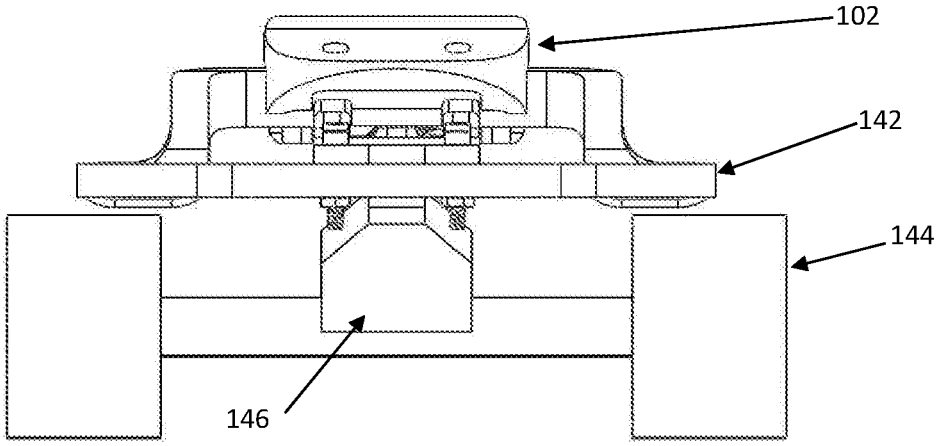
FIG. 10 is a front view of the longboard (100) and brake (102) shown in FIG. 1.
Figure 11:
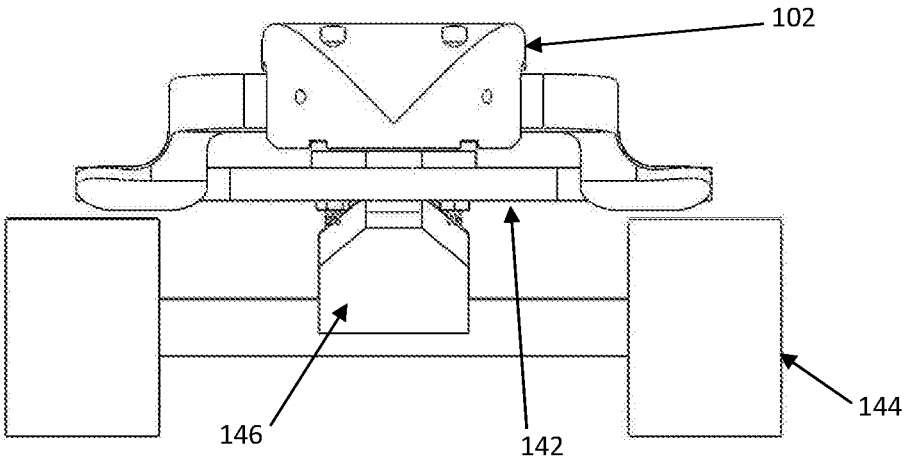
FIG. 11 is a rear view of the longboard (100) and brake (102) shown in FIG. 1.

As shown in the top view in FIG. 8 the brake arm (110) extends beyond the sides of the deck (142) to the areas above the wheels (144) and forward of the center point of the wheel (144). Typically the brake surfaces (116) engage the wheels (144) in the top forward quadrant of the wheel (144) which optimizes the smoothness of the braking action. As can be seen in FIG. 8, the brake actuator shell (102) is positioned in the midline of the deck (142) to maximize the riders balance when using the brake. In this manner, switching back and forth from a non-braking stance to a braking stance is easy, intuitive, repeatable, centered, and requires minimal leg and foot motion, for example the rider's foot needs to move only minimally so that the heal can engage with the actuator shell (102), and therefore the system does not disturb the rider's balance. Conversely for example, if the rider is required to apply the braking force to the side of the board, the board can be inadvertently turned or the rider could lose his or her balance. The front and rear views in FIGS. 9 and 10 respectively also show the center symmetry of the brake (102) compared to the deck (142).

Figure 12:
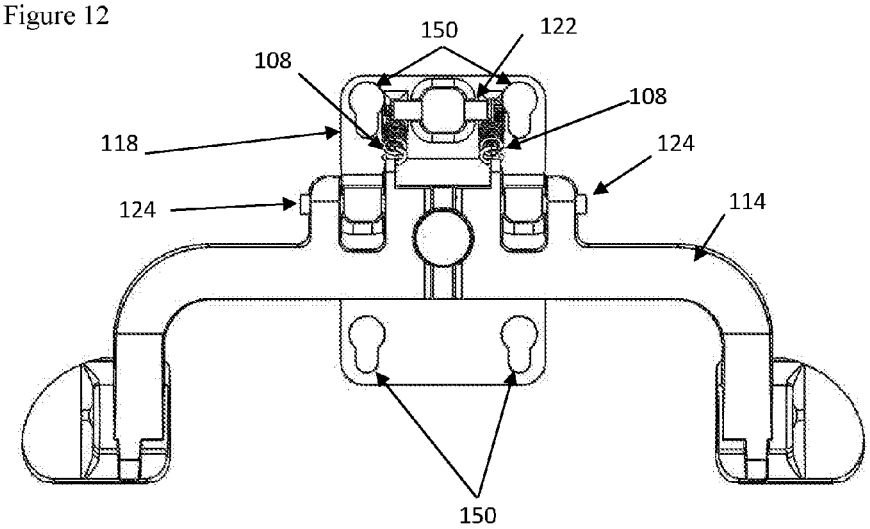
FIG. 12 is a top view of the brake arm (114) and mounting plate (118) brake assembly (102) shown in FIG. 1 with the actuator shell (106) removed for clarity.

FIG. 12 shows a top view of the brake system assembly however with the brake actuator shell (106) removed for the purposes of describing some of the mounting hardware. The brake arm (114) is pivotably attached to the base plate (118) with the use of a pivot pin (124). The brake arm (114) is attached to the base plate (118) also with two return springs (104) which brings the brake arm (114) upward to its resting state whenever the brake surface (116) is not being actuated. The base plate (118) is attached to the deck (142) and truck (146) with four bolts (104) of the exact pattern typical of an existing truck (146) attachment bolt pattern. The bolt holes can be slotted or larger than the bolts (104), or there may be an array of bolts in order to accommodate different truck (146) styles, making the mounting to the board truly universal, and without requiring board modification. The configuration in FIG. 12 shows keyhole slots (150) that have a hole larger than the mounting bolt head, and a slot larger than the mounting bolt shaft, but the slot is smaller than the mounting bolt head. This allows the bolt head to slip through, then slide over the bolt shaft. Assembly with this configuration would entail loosening the mounting bolts (104), placing the brake system (102) over the mounting bolt heads through the hole portion of the keyhole slot (150), sliding the brake system (102) backward to engage the slot portion, then tightening the mounting bolts (104). Complete removal of the mounting bolts (104) is not necessary and in most cases, the standard mounting bolts (104) that hold the truck (146) to the deck (142) should be compatible with this brake system (102) and do not need to be replaced. This exemplifies the ease of assembly and connection to the board (100).

Figure 13:
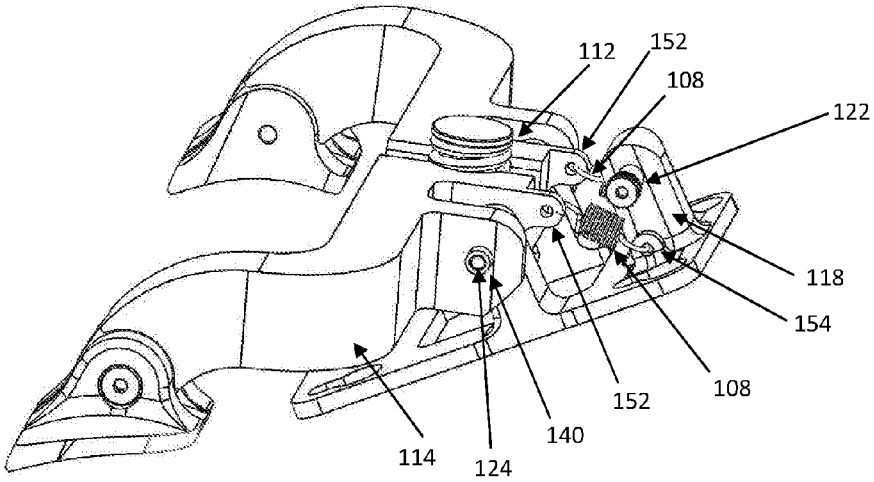
FIG. 13 is an isometric view of the brake arm (114) and mounting plate (118) brake assembly (102) shown in FIG. 12, with the actuator shell (106) removed for clarity.
Figure 14:
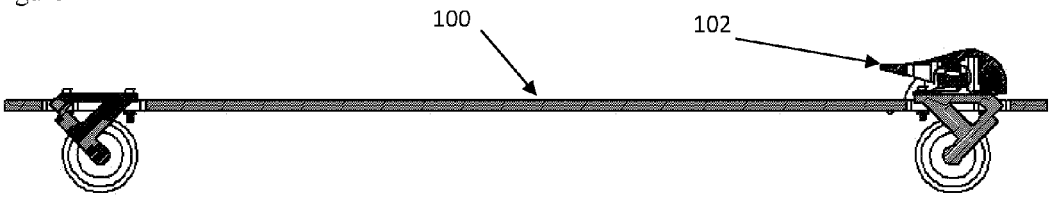
FIG. 14 is a side view cross section from front to back through the longboard (100) and brake (102) shown in FIG. 1, when the brake (102) is in the fully disengaged state.

FIG. 13 is an isometric view of the brake system without the actuator shell (106) shown in FIG. 12. The actuator shell (106) has been removed to show the mechanisms inside. The return spring (108) was previously mentioned and in FIGS. 12, and 13, there are two. One or two can be used to accomplish the same function. In FIGS. 12 and 13, the mounting of these return springs to the brake arm is done with integrated retention features (152) off of the brake arm (114) versus the return spring mounting screws (110) mentioned before. Similarly, there are return spring retention features on the base mounting plate (154). These features make assembly easier and reduce overall cost of manufacturing.

Figure 15:
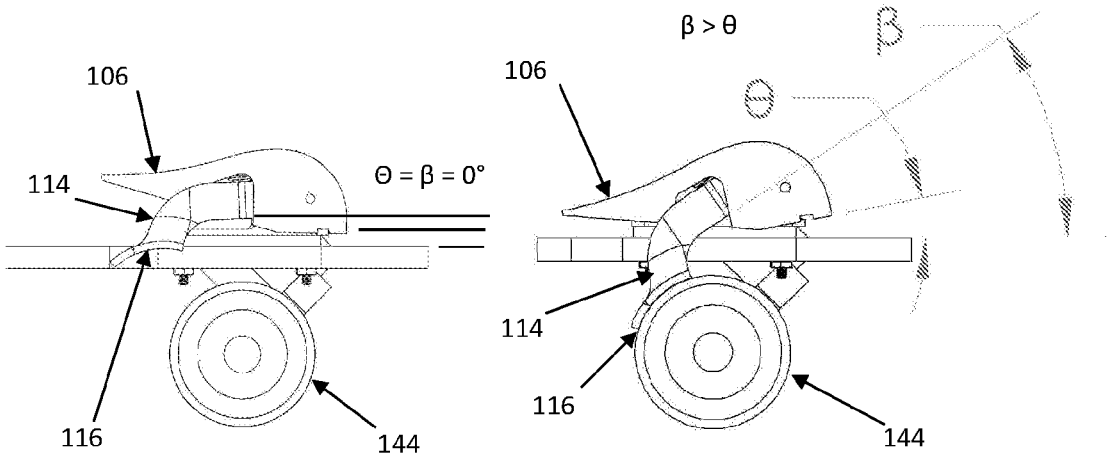
FIG. 15 is a close up view of the brake (102) shown in FIG. 1 illustrating the stroke multiplier mechanism.
Figure 16:
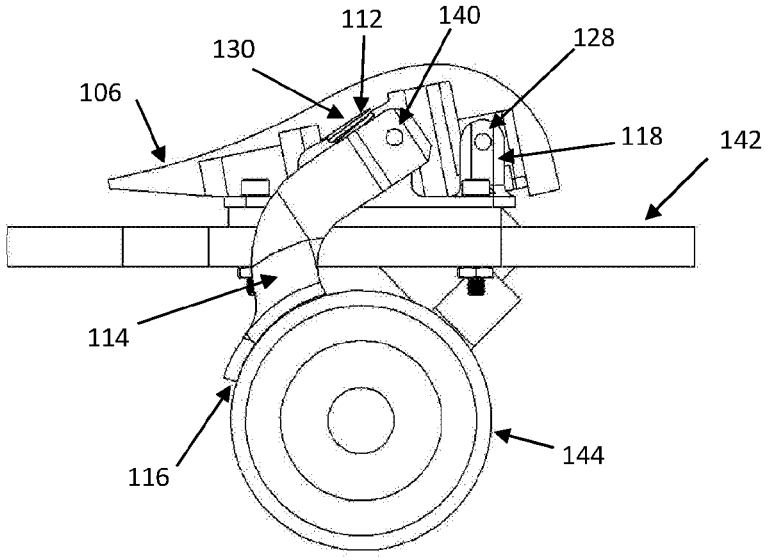
FIG. 16 is a side view of the brake (102), with the actuator shell (106) sectioned, to better illustrate the positions of the actuator shell pivot hole (128), the brake arm pivot hole (140), and the cam surface (130) for the force transmission spring.

Clearance is required between the brake surface (116) and the wheel (144) in order to not compromise the turning capabilities of the trucks (146) and longboard (100). When turning, the longboard deck (142) gets closer to the wheels (144) on the inside part of the turn. Turning also brings the wheels (144) closer to the deck (142). This can be seen in FIGS. 19-21. Because of this, the brake surface (116) must be high above the wheels (144), when not engaged, to allow clearance during the turning maneuver. This large, required, clearance distance is counter to the desired actuation stroke for the brake system (102). The ideal actuation stroke is small so as to allow the rider to keep their foot on the board (100) during operation. If the actuation stroke is large, it may require lifting the operator's foot off of the board (100) during riding which would lead to instability. Riding with both feet on the board (100) is more stable. The invention described in this patent allows for a small enough actuation stroke to allow the operator to leave both feet on the deck (142), resulting in stability, but still provides adequate wheel (144) clearance for turning. This is due to the stroke multiplier mechanism. The stroke multiplier mechanism is comprised of the actuator shell (106) and its pivot axis, the brake arm (114) and its pivot axis, and the cam (130) contact surface of the actuator shell (106) and the force transmission spring (112). Because the pivot hole (128) of the actuator shell (106) is well behind the pivot hole (140) of the brake arm (114), and the actuator shell cam surface (130) contacts the force transmission spring (112) in front of the brake arm pivot hole (140), angular displacement of the brake arm (114) is a multiple of the angular displacement of the actuator shell (106). For a given angular displacement $\theta$ for the actuator shell (106), the brake arm (114) is displaced a larger angle of $\beta$. This is represented in FIGS. 15 and 16.

Figure 19:
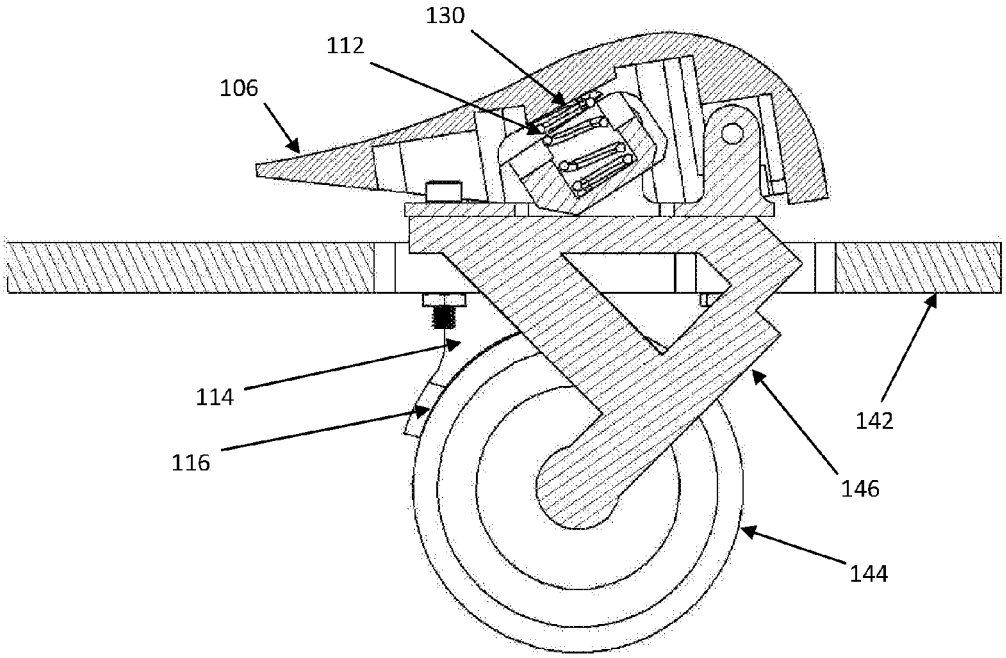
FIG. 19 is a cross-sectional side view of the brake area of the longboard (100) and brake (102) shown in FIG. 1 in which the brake's second stage begins to be engaged for braking with the brake actuator shell (106) pressing directly on the brake arm (114).
Figure 20:
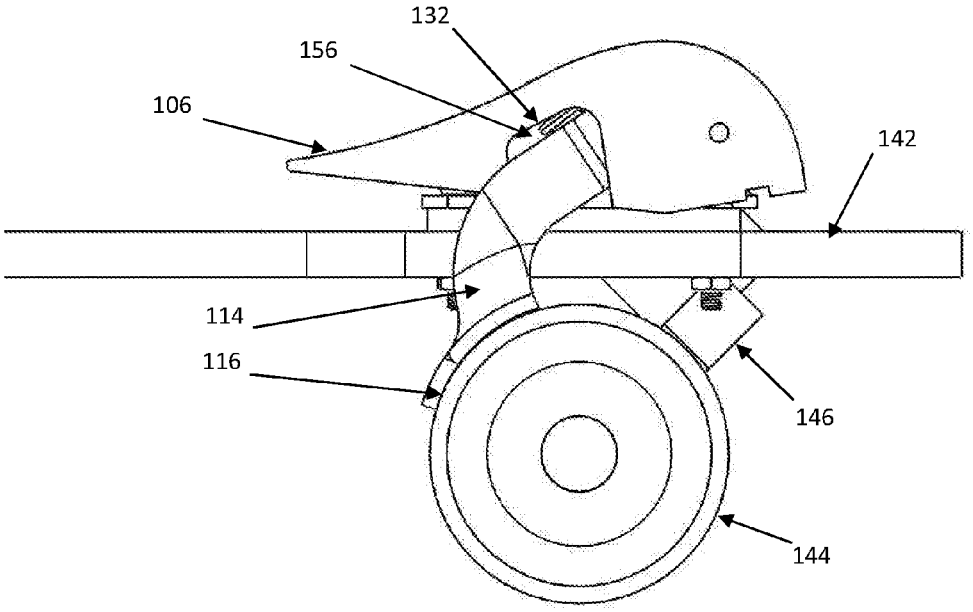
FIG. 20 is a side view of the brake area shown in FIG. 19.
Figure 21:
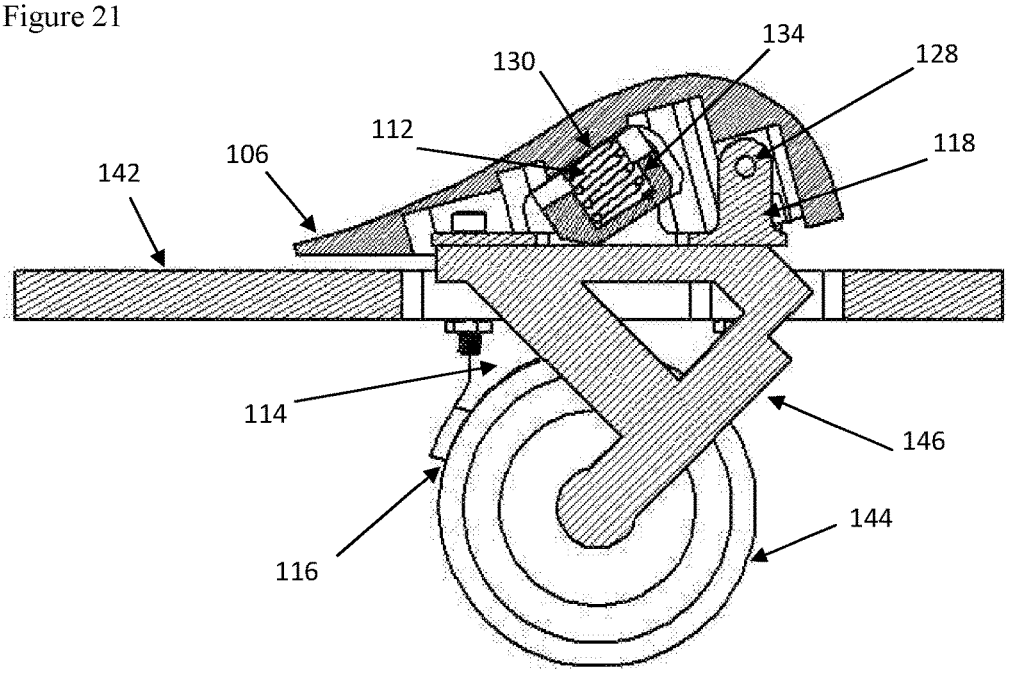
FIG. 21 is a cross-sectional side view of the brake area of the longboard (100) and brake (102) shown in which the brake's second stage is fully engaged for braking with the brake actuator shell (106) pressing the brake arm (114) engaging the brake surface (116) fully into the wheel (144).
Figure 22:
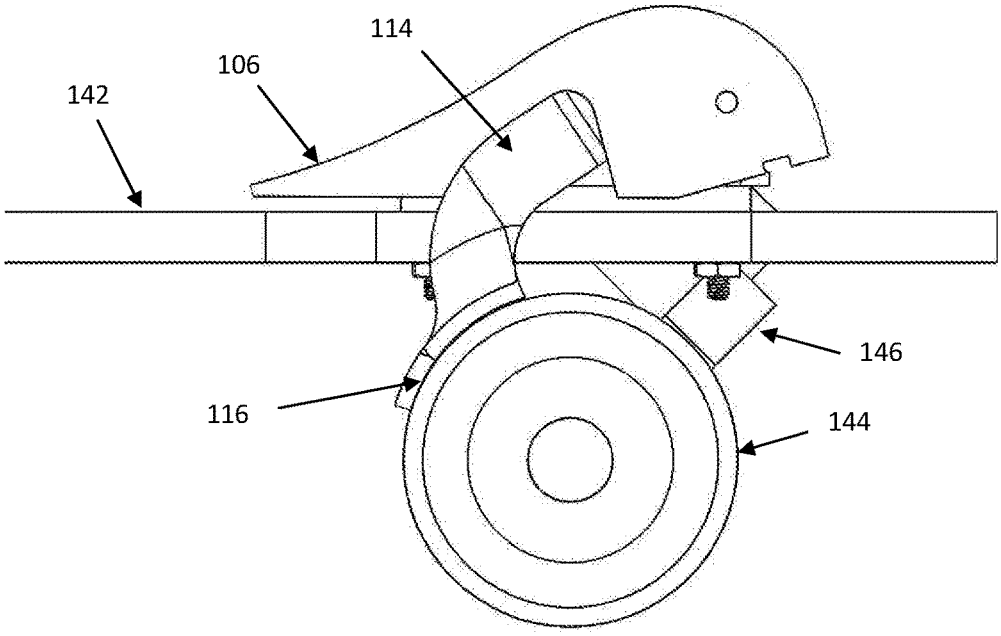
FIG. 22 is a side view of the brake area shown in FIG. 21.

FIG. 17 shows a table that summarizes the dual stage braking feature of the brake system invention. On the left column, there are the different stages of braking, including stage 0 which is at rest, no braking. The furthest right column lists out the associated types of braking for each braking stage. The second, third, and fourth columns describe the different states of the mechanisms for each of the braking stages. At stage 0, the actuator shell (106) is not depressed, the braking surface (116) is at its maximum distance from the wheels (144), the force transmission spring (112) is not compressed, so there is no braking force. This is shown in as a cross-section in FIG. 18. At stage 1, the actuator shell (106) is depressed and the braking surface (116) is contacting the wheels (144) but the actuator shell (106) is not at its maximum actuation state. Instead, it is depressed based on the preference of the rider. The more it is depressed, the more it compresses the force transmission spring (112), and the more braking force is generated. In stage 1, the actuator shell (106) contacts the force transmission spring (112) which contacts the brake arm (114) which drives the brake surface (116) to the wheels (144). The braking force is governed by the compression of the force transmission spring (112) in stage 1 which allows a great deal of braking force adjustability. FIGS. 19 and 20 show the brake system (102) in stage 1. One other characteristic of stage 1 braking is the gap (156) between the actuator shell (106) and the brake arm (114). If there is a gap (156) between the actuator shell (106) and the brake arm (114), and the braking surface (116) is contacting the wheels (144), then the brake system (102) is in stage 1. In stage 2, the actuator shell (106) is fully depressed, the braking surface (116) is contacting the wheels, the force transmission spring (112) is compressed such that the actuator shell (106) contacts the brake arm (114) directly, and the maximum brake force is achieved. In stage 2, there is no gap (156) between the actuator shell (106) and the brake arm (114). FIGS. 21 and 22 show the brake system (102) in stage 2. The braking force adjustability found in stage 1 is beneficial because it allows the rider to decelerate slowly if desired. If a maximum deceleration rate is desired, the rider continues to depress the actuator shell (106) into stage 2 which provides the maximum braking force. It should also be noted that an alternative configuration for the force transmission spring (112) can come in various form factors such as the helical wire form shown or a compliant elastomeric component.

FIG. 19 is a close up cross sectional view of the brake system (102) in the partially engaged condition, or stage 1. FIG. 20 is a side view of the brake system (102) in the same state, stage 1. The actuator shell (106) is pivoted downward compressing the force transmission spring (112), which is deflecting the brake arm (114) to pivot downward and causing the braking surface (116) part of the brake arm (114) to swing or pivot downward and rearward ultimately to contact the wheels (144). In this braking state, the actuator shell (106) is not directly transmitting force to the brake arm (114), and the braking force is that which is dictated by the compression of the force transmission spring (112). FIG. 20 shows the gap (156) that exists between the actuator shell (106) and the brake arm (114) highlighting that those two components are not contacting and not directly transmitting force.

FIG. 21 is a close up cross sectional view of the brake system (102) and FIG. 22 is a side view of the brake system (102) however with the actuator shell (106) making direct contact with the brake arm (114), thereby beginning to emit force directly to the brake arm (114) and thus increase the brake force beyond that that is exerted by the force transmission spring (112) to a greater force that is exerted by the rider's weight or pressing force. FIGS. 21 and 22 show the brake system (102) in stage 2 of braking.

Figure 23:
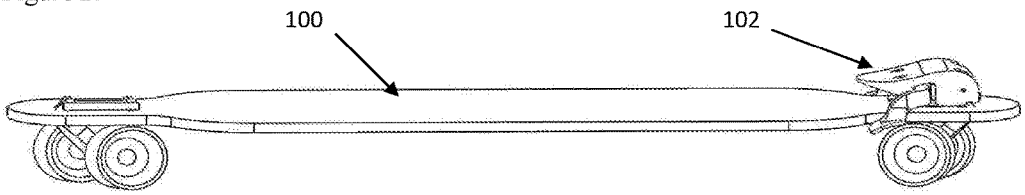
FIG. 23 is an isometric view of the board (100) and brake (102) with the board in a full maximum turn and when the brake is not actuated, showing the brake surface (116) clearance with the wheel (144) during a maximum turn state of the board (100).
Figure 24:
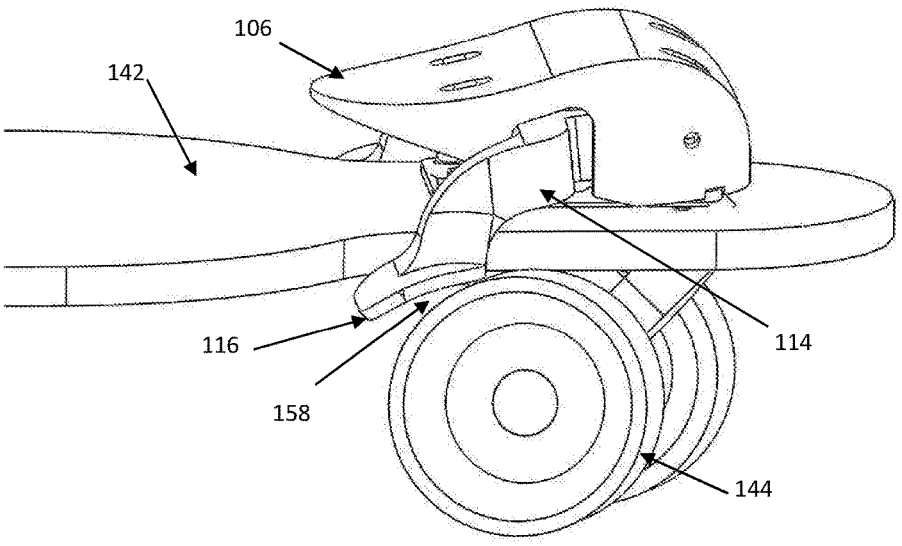
FIG. 24 is a close up view of the board (100), brake (102) and wheel (144) shown in FIG. 23.
Figure 25:
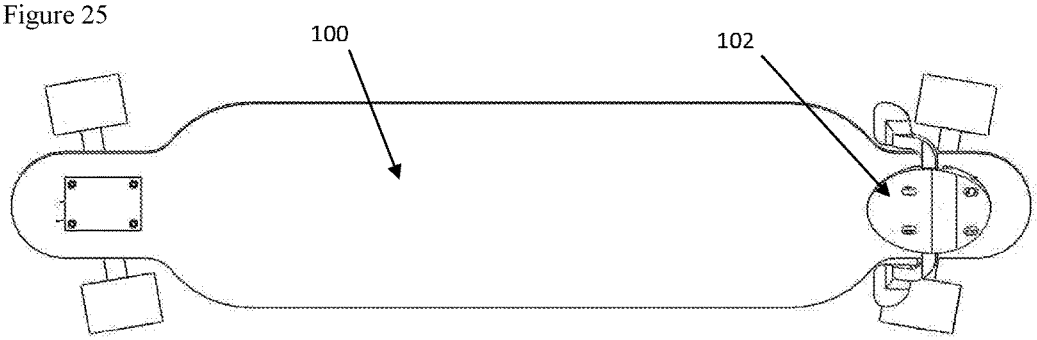
FIG. 25 is a top view of the board (100) and brake (102) shown in FIG. 23.

FIG. 23 is an isometric view of the board (100) and brake (102) shown during a turn, and FIG. 24 shows a close up view of the same. As can be seen, during a maximal turn in which the board deck (142) is maximally tilted and the truck (146) is maximally pivoted, which is the basic design principle of turning a board (100), there is still clearance between the brake surface (116) and wheel (144), thus preventing inadvertent engagement of the brake during a turn. It is this embodiment that further separates this invention from the prior art. In order for this invention to achieve this aspect of performance, the clearance of the brake surface (116) with respect to the wheel (144) is exaggerated when the board is unturned, and in order to accommodate this exaggerated clearancea stroke multiplier is preferred such that the rider can reasonably actuate the brake with reasonable amounts of deflection. Otherwise, either (a) the brake would undesirably bind up with the wheel (144)

during a turn, and/or (b) the rider would be required to deflect the brake mechanism with unreasonable amounts of deflection and motion causing the rider to lose balance during braking. FIG. 25 is a top view of the board and brake (102) shown in FIGS. 23 and 24, also showing the position of the brake (102) and wheels (144) during a maximal turn, when the brake (102) is not engaged.

Figure 26:
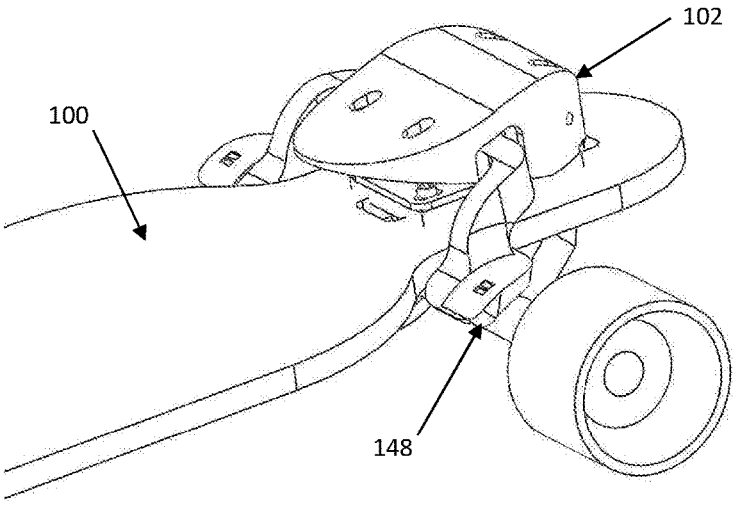
FIG. 26 is a close up isometric view of the brake (102) when in the disengaged position.

FIG. 26 shows a front-side isometric view of the brake system (102), with the board (100) in an unturned state, and the brake (102) in a fully disengaged position. This view shows clearance between the actuator shell (106) and brake arm (114), and clearance between the actuator shell (106) and deck (142), and clearance between the brake surface (116) and wheel (144). In addition replaceable brake surfaces (148) are shown, with a quick connect feature (138).

Figure 27:
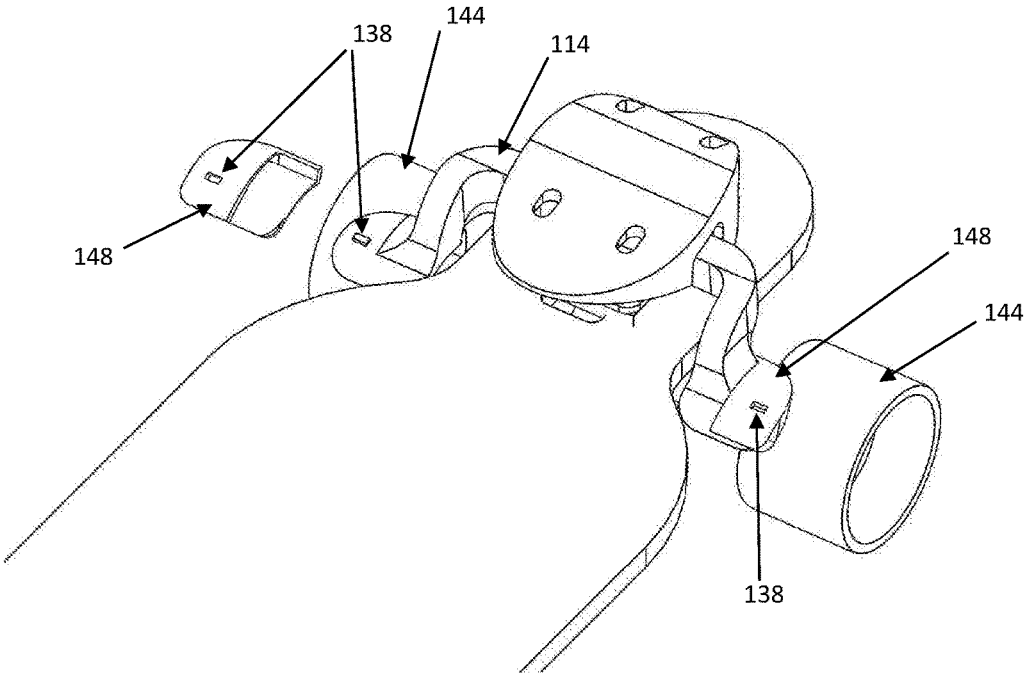
FIG. 27 is an exploded view of the brake system (102) with a pivoting brake pad (162) mechanism that also can be detachable.

FIG. 27 shows the same brake shown in FIG. 26 with one of the replaceable brake surface (148) detached and the other attached. The replaceable brake surface (148) slides on to the brake arm (114) and attaches with a snap detent feature (138) allowing for easy attachment and detachment. The replaceable brake surfaces (148) may be comprised of a material that doesn't bind when pressed against the wheel (144), yet a softer material than the wheel (144) itself such that the replaceable brake surface (148) wears rather than the wheel (144) wearing as a result of repeated braking over time. The replaceable brake surface (148) can be curved to match the curvature of the wheel (144), and can have features to prevent binding, such as a rounded surface, groove or rib.

Figure 28:
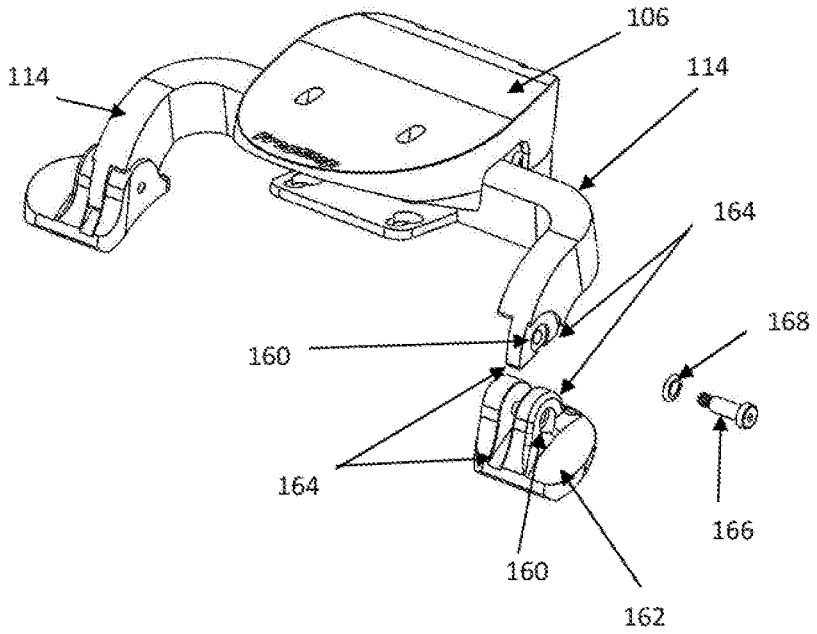
FIG. 28 shows the initial contact of the pivoting brake pad (162) to the wheel (144).

With a non-pivoting brake surface (116), as described earlier with the one piece braking arm (114), a unique position of the wheel (144) relative to the board exists for optimal braking. Because the braking surface (116) is a fixed feature of the braking arm (114), to achieve the maximum contact to the wheel (144), this unique position of the wheel (144) relative to the truck base (146) is required. If it is not in this unique position, a maximum contact of the brake surface (116) to the wheel (144) will not result. It is preferred to maximize the contact area of the brake surface (116) on to the wheel (144). The braking force is distributed over the contact area so if the area is maximized, distribution of the force is spread out over a large area. A small contact area will result in a concentration of the force in a localized spot which may generate a large amount of heat. This heat may melt and damage the skateboard wheels (144). There are several reasons why the wheels (144) may not be in this unique. One reason is that skateboard trucks (146) are designed to be adjustable depending on the style of riding chosen by the rider. This adjustability stiffens the turning capability of the truck (146) but also varies the height of the wheel (144) relative to the truck base (146). This continuum of adjustability leads to a continuum of deck (142) positions relative to the wheel (144). Another reason is that different truck (146) manufacturers may have various designs in which the position of the wheel (144) to the truck base (146) is different. Yet another reason that the position may not be optimal is that the wheel (144) diameters may vary. Skateboard wheels (144) come in various diameters and this variation may cause the position to be suboptimal. A solution to the problem stated above is to add a pivoting feature (160) to the brake arm (114). FIG. 28 shows an exploded view of the brake system (102) with a braking arm (114) that has the pivoting brake pads (162) as separate pieces. If the pivoting brake pads (162) are allowed to pivot about an axis (160) on the brake arm (114), it can allow for different positions relative to the truck base (146). It can also allow for different wheel (144) sizes. As the rider actuates the brake (102), the brake pad (162) automatically adjusts to the position and wheel (144) size by pivoting. FIG. 28 shows the braking arm (114) with pivoting brake pads (162) that pivot about an axis (160), held together with a shoulder bolt (170) and a spring washer (172). Because the pivoting brake pad (162) can move relative to the brake arm (114), clearance is required between the brake pads (160) and the brake arm (114). This clearance may result in an undesirable rattle during riding. This clearance can be taken up or absorbed with a compressible component such as a spring washer (172). The compressible component or spring washer (172) would be assembled in between the brake pad (162) and the brake arm (114) such that it is under compression. This compressed spring washer (172) would result in a light force between the parts that will prevent undesirable rattling during riding but will allow the necessary pivoting. This pivot hinge (160) mechanism also has features to prevent over rotation of the pivoting brake pad (162). The pad (162) should be positioned in a zone that allows it to re-position itself as it makes contact with the wheel (144). If the pad is over rotated, re-positioning may not be possible. These over rotation stopping features (164) keep the pad (162) inside of this zone, allowing it to re-position itself properly during contact with the wheel (144). They consist of hard stops (164) where the pivoting brake pad (162) collides into the brake arm (114) providing limits of rotation.

Figure 29:
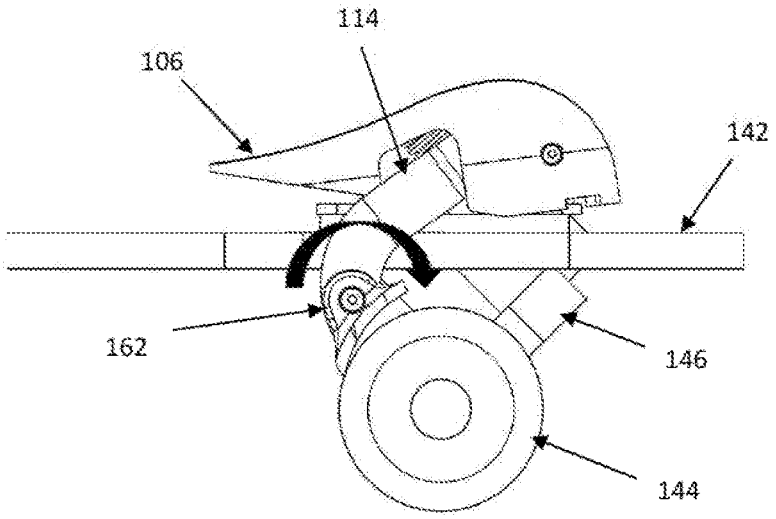
FIG. 29 shows the brake pad (162) pivoting into its final contact position with the wheel (144).
Figure 30:
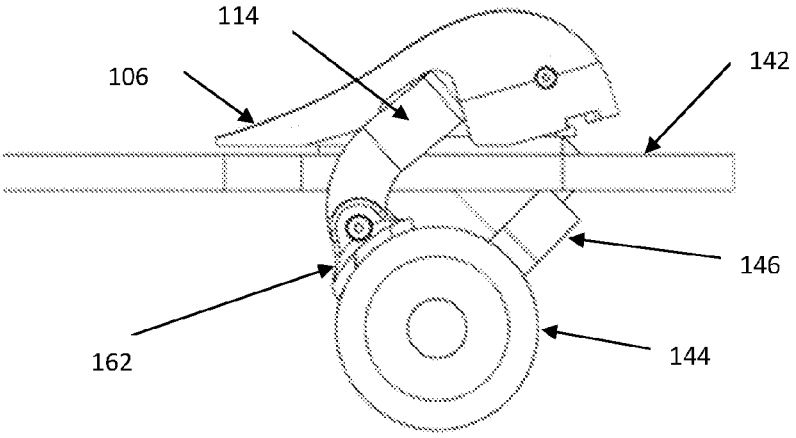
FIG. 30 shows the pivoting brake pad (162) with force concentration bumps or ribs (170).

FIG. 29 shows the initial contact of the pivoting brake pad (162) to the wheel (144). This illustrates that if the wheel (144) is in a suboptimal position relative to the deck (142) or if the wheel (144) is of a size that is not ideal, the initial contact will also be suboptimal. FIG. 30 shows that with further actuation of the actuator shell (106), the pivoting brake pad (162) automatically conforms to the optimal position allowing for proper and optimal engagement of the pivoting brake pads (162) to the wheels (144).

Figure 31:
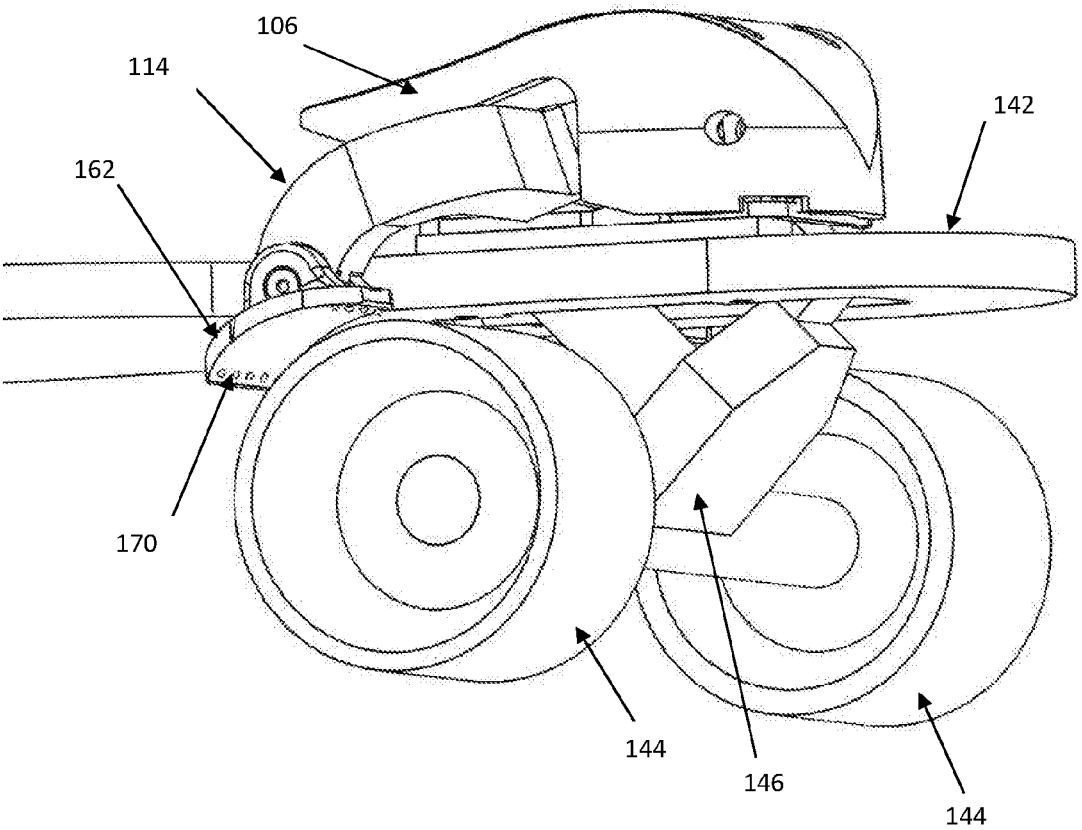
FIG. 31 shows the pivoting brake pad (162) detached from the brake system (102), illustrating the force concentration bumps or ribs (170).
Figure 32:
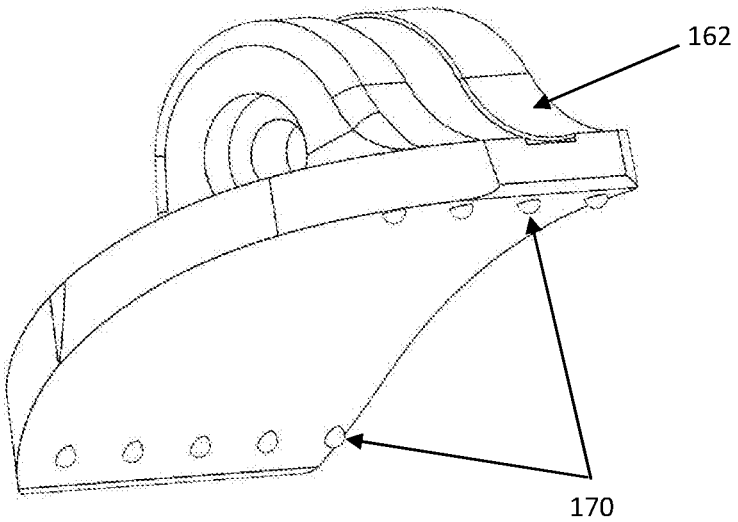
FIG. 32 shows the pivoting brake pad (162) detached from the brake system (102), illustrating replaceable force concentration plugs (174).
Figure 33:
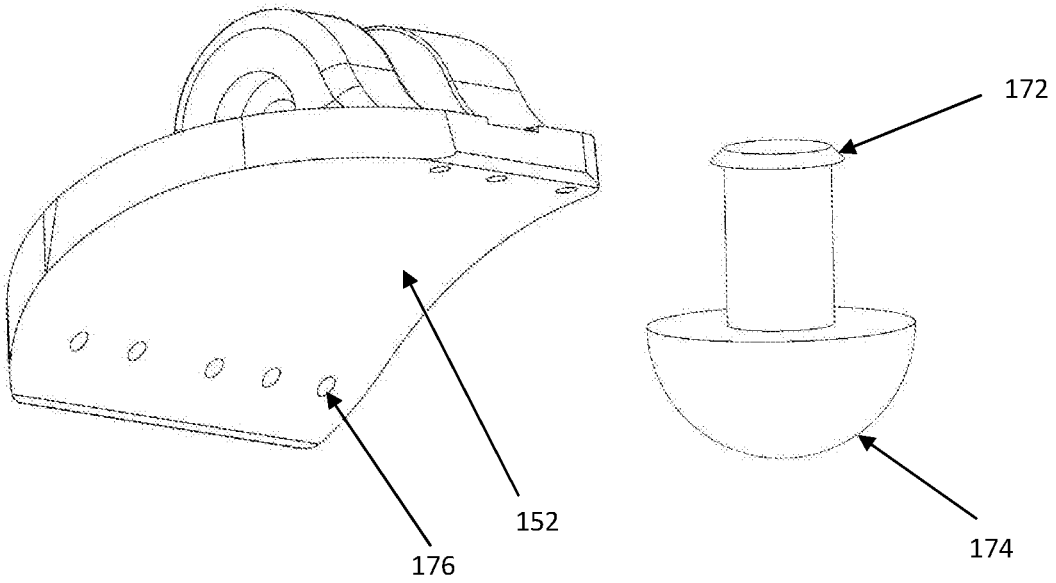
FIG. 33 shows the replaceable force concentration plugs (174) being inserted into mounting holes (176).
Figure 34:
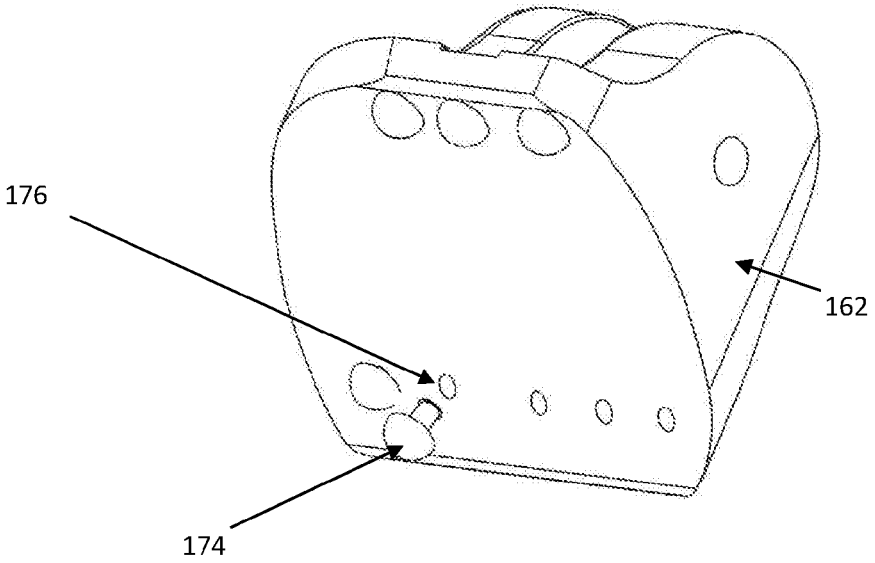
FIG. 34 is the brake system (102) mounted to a skateboard (100), with pivoting brake pads (162) that also have heat sink fins (180).

The invention herein applies to high performance braking systems and recreational braking systems. The recreational braking systems typically includes maximum brake surface (116) contact which will not damage typical skateboard wheels (144) and will provide adequate braking performance. When high performance braking is required, the same invention can be utilized with an additional feature to the brake pads (162). FIGS. 31 and 32 show an alternative embodiment to the pivoting brake pad (162) previously described that could provide higher performance. Higher braking performance can be defined as the ability to decelerate at higher speeds and/or the ability to decelerate in less distance. It can also be defined as requiring less actuation force. This can be accomplished by increasing the deceleration force. The deceleration force is defined as $Fd=\mu N$ where $\mu$ is the coefficient of friction and N is the braking force applied to the wheel. By adding bumps or ribs (170) to the brake surface (116), the contact area is minimized which concentrates the braking force to those areas versus distributing the force over a larger contact area. These raised elements (170) act as gripping features by minimizing the contact area which concentrates the braking force which increases N which increases the deceleration force. The brake force is distributed over the contact area. Minimizing the contact area will concentrate the braking force because the area in which the brake force is distributed is smaller. However, as stated previously, concentrating the force on a smaller area can also generate high heat which may melt and damage the skateboard wheels (144). In this embodiment, it may also be necessary to accompany this type of brake pad (162) with high melt temperature rubber skateboard wheels or tires (186). It is believed that this higher braking performance may be advantageous enough to warrant the requirement of specific and non-typical skateboard wheels FIGS. 33 and 34 shows a pivoting brake pad (162) with disposable force concentration plugs (174). These inserts (174) have a snapping feature (172) that engage into mating cavities (176) of the brake pad (162). The head of the plug (174) have the raised geometry necessary to concentrate the braking force. As the force concentration plug (174) wears, it is easily replaced by disengaging the remnants from the brake pad (162). The removable approach would allow them to wear out and then be replaced more economically than replacing the whole brake pad (162). These inserts can be made of different materials including steel, aluminum, and various plastic polymers. The variation in materials can provide different types of braking performance and wear resistance.

Figure 35:
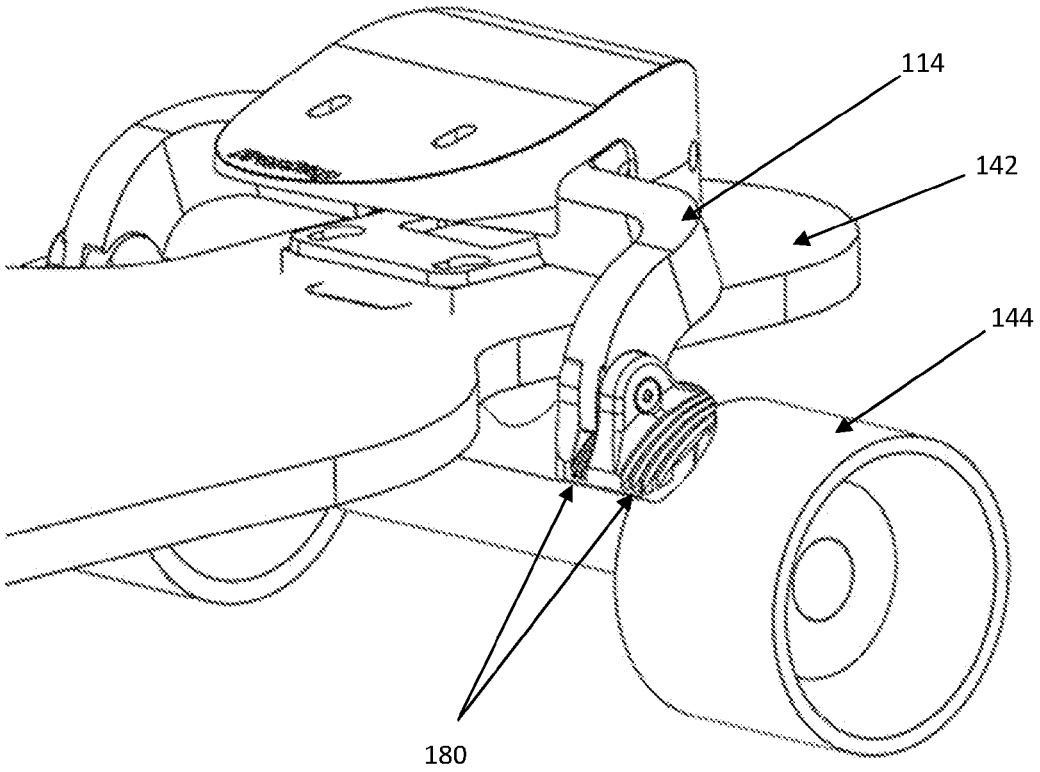
FIG. 35 is the pivoting brake pad (162) with the heat sink fins (180).
Figure 36:
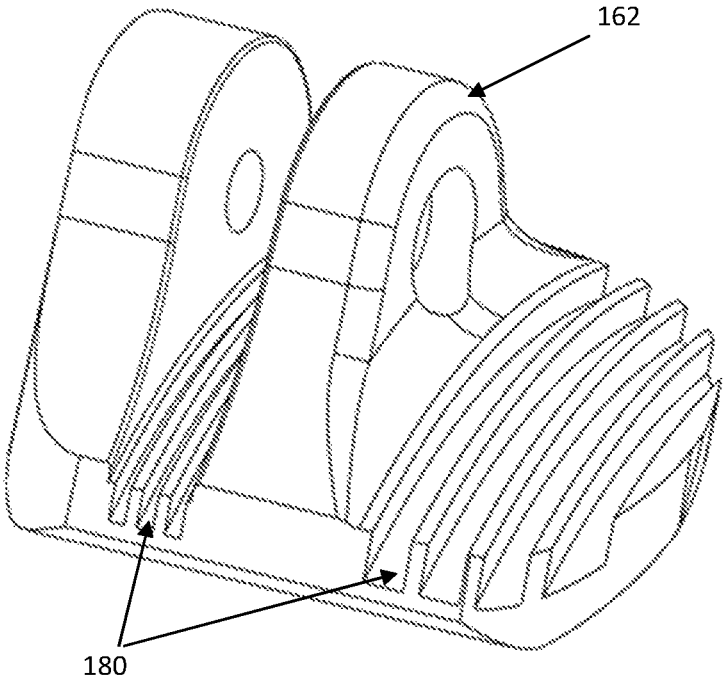
FIG. 36 is the pivoting brake pad (162) with the heat sink fins (180), force concentration ribs (182), aluminum or metal rims (184), and high melt temperature rubber tires (186).

FIGS. 35 and 36 show a pivoting brake pad (162) with heat sink fins (180). The heat sink fins (180) are intended to dissipate the heat generated from general braking and/or the heat from the force concentration features (170). Aluminum, because of its thermal conductivity, would be a good brake pad (162) material choice for heat dissipation. The heat sink fins (180) increase the surface area of the pivoting brake pad (162) and in combination with the air flow would allow heat to be dissipated preventing damage to the skateboard wheels (144).

Figure 37:
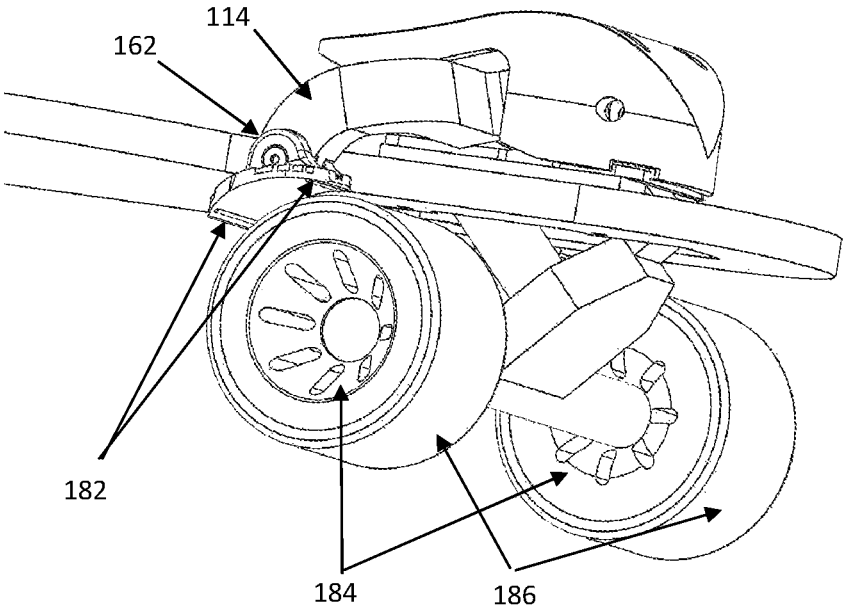
FIG. 37 shows the brake system (102) with the pivoting brake pad (162) attached to the brake arm (114) with a shoulder bolt (166) secured with a cotter pin (188).
Figure 38:
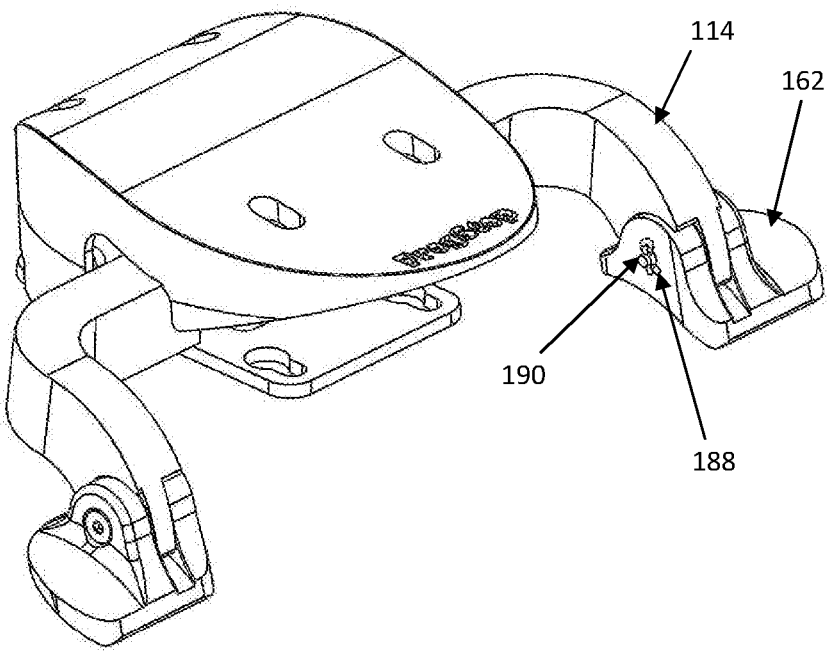
FIG. 38 is a close up view of the pivoting brake pad (162) attached and secured with a shoulder bolt (166) and a cotter pin (188) shown in FIG. 37.
Figure 39:
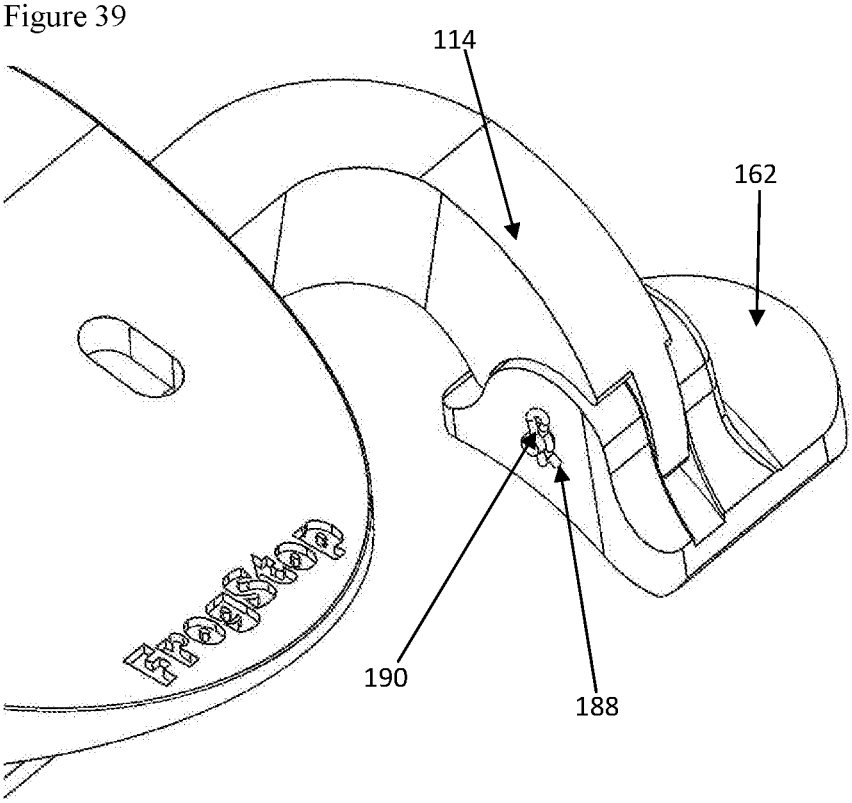
FIG. 39 is an exploded view of the brake system shown in FIG. 37.
Figure 40:
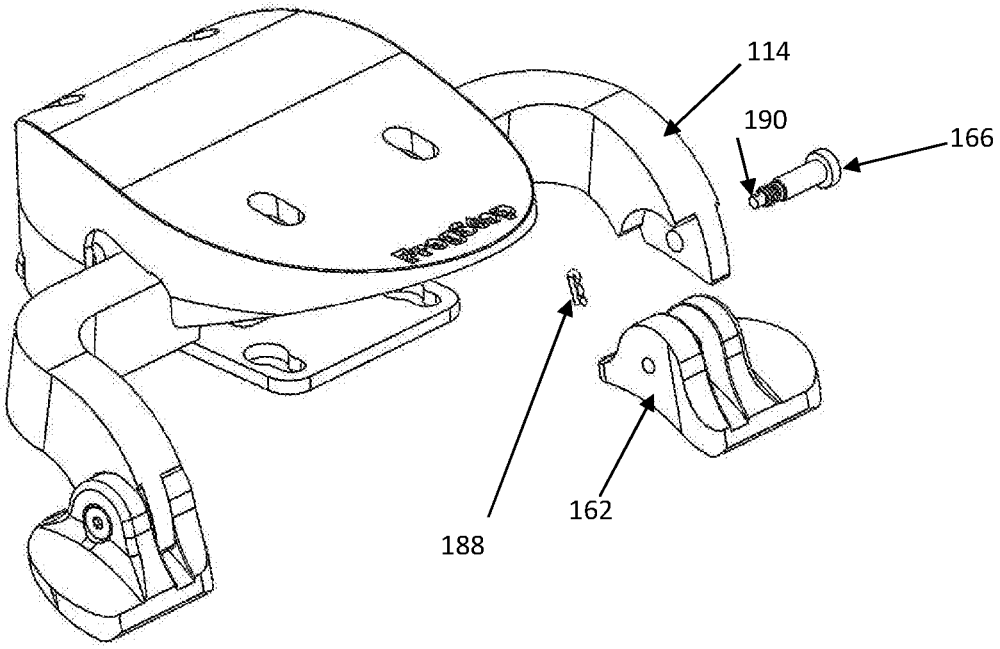
FIG. 40 is an exploded view of the close up view in FIG. 38.
Figure 41:
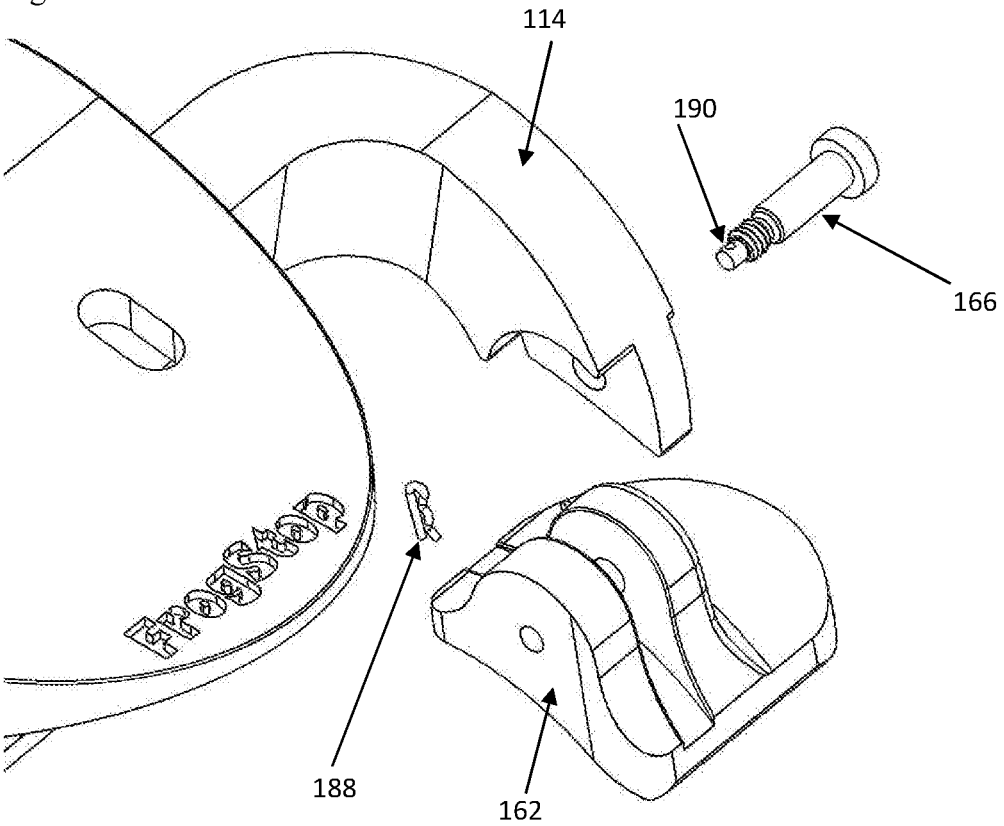
FIG. 41 is a view isolating the shoulder bolt (166) and the cotter pin (188).

FIG. 37 shows the underside of the pivoting brake pad (162) with force concentration ribs (170) along with the skateboard with aluminum rims (184) and high melt temperature rubber tires (186). One way to manufacture this high temperature rubber wheel would be to first machine or cast the rim out of aluminum. The next step would be to take the rim and over mold the high temperature rubber (186) on to the rim (184). The standard skateboard wheels (144) have plastic rims with polyurethane wheels. The proposed aluminum rim (184) would have sufficient strength and high melt temperature and would lend it itself to be over molded with the high temperature rubber. It's also conceivable that the tire (186) be molded separately then assembled on to the rim (184).

Attachment of the pivoting brake pad (162) can be accomplished with a shoulder bolt (166) as described above. To prevent inadvertent unthreading and detachment due to normal vibration during riding, a threadlock can be used. This can be accomplished with a plastic patch such as nylon applied to the thread of the shoulder bolt (166) or an adhesive threadlock placed on the thread during assembly of the brake pad (162). Both are commonly used to prevent screws from inadvertent unthreading during vibration. In both cases, it should be considered that high heat can be a factor during braking so the exact compound used for threadlocking should withstand these high temperatures. An alternative method to secure the shoulder bolt (166) is to use a cotter pin (188) as shown in FIGS. 38 through 41. In these Figures, the shoulder bolt (190) has an extension which a cross-hole (190) is drilled to allow for a cotter pin (188). After the shoulder bolt (166) is assembled to the brake pad (162) and brake arm (114), a cotter pin (188) is placed through the cotter pin hole (190), securing the shoulder bolt (166), preventing inadvertent unthreading. This too is common practice in securing pins and bolts to vibrating assemblies. This method can be advantageous over the plastic or adhesive threadlock because a metal cotter pin (188) along with a metal shoulder bolt (166) are capable of handling the high temperatures during braking. It also allows for easy attachment and detachment of the brake pads (162) if the rider wants to upgrade the pads (162) for high performance ones.

Figure 42:
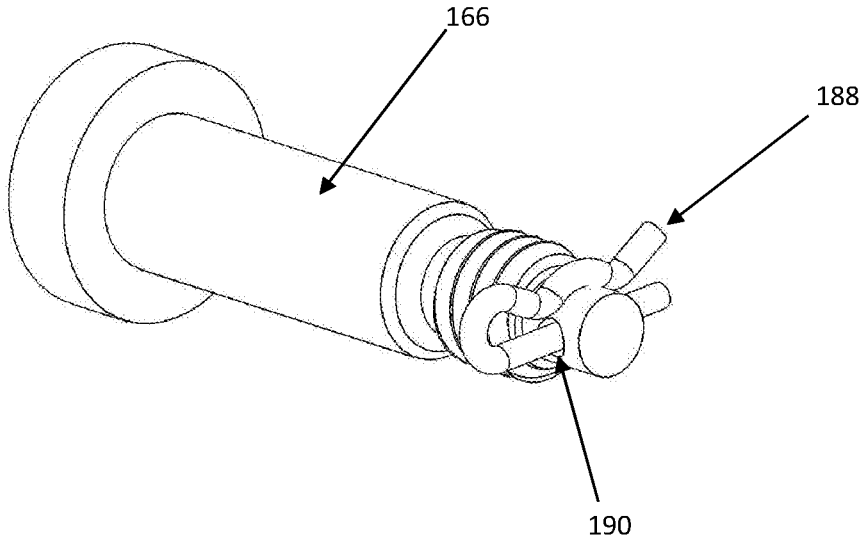
FIGS. 42 and 43 show an example of the shoulder bolt (166) and cotter pin (188) shown in FIG. 41.
Figure 43:
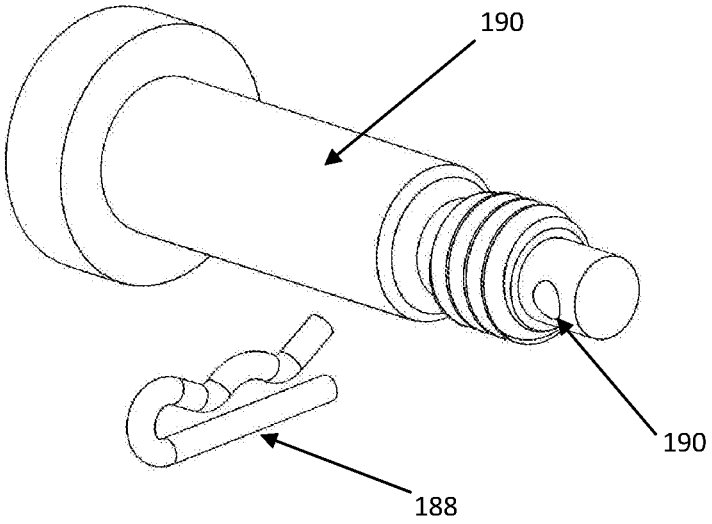

FIGS. 42 and 43 show the cotter pin (188) locking with shoulder bolt (166) locking mechanism without any other components for clarity. FIG. 42 shows the cotter pin (188) locking to the shoulder bolt (166) while FIG. 43 show the two components in an exploded view.

Figure 44:
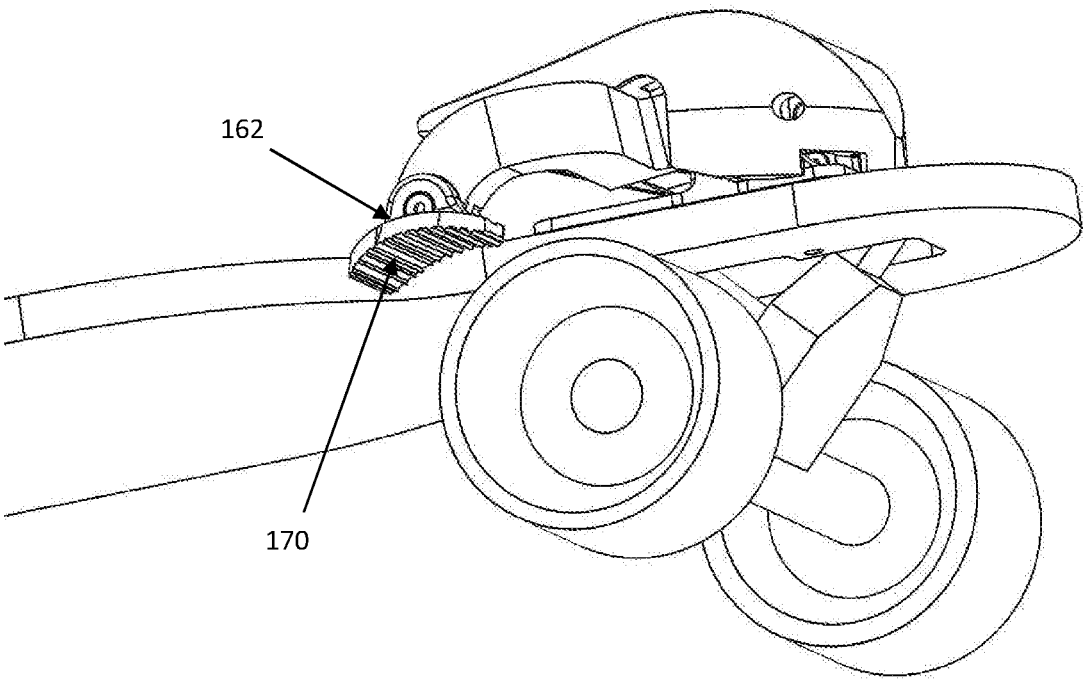
FIGS. 44 and 45 show an example an irregular break surface.
Figure 45:
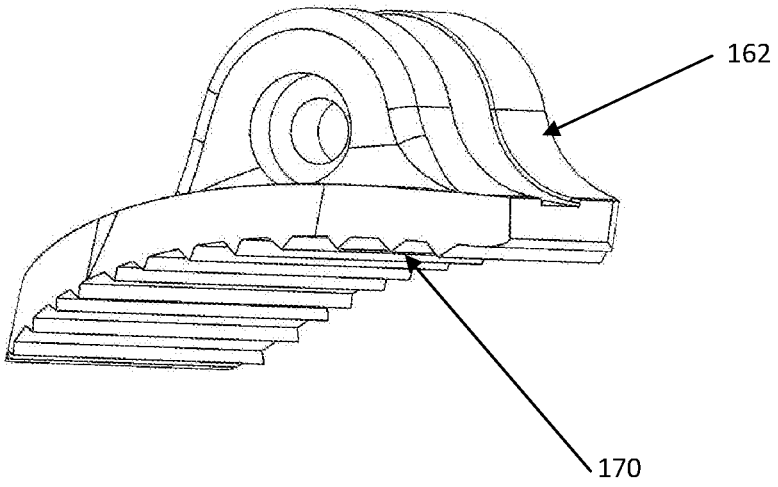

FIGS. 44 and 45 show an example of where the brake surface 170 comprises an irregular surface, which can include lines, a V-shape ridge, raised bumps, or any surface to modify the brake surface 170 from being a smooth surface The invention also contemplates a hand brake cable system coupled to the brake actuator pad, for example a push-pull rod mounted between the front bottom of the actuator pad and deck. In this case the length of the mounting plate is extended in the forward direction for connection of the bottom of the rod. Actuation of the handbrake will compress the push rod to deflect the brake actuator pad downward, and releasing of the handbrake will allow the actuator pad to return to the up position. The invention also applies to non-wheeled conveyances, such as a snowboard, in which case the brake shoes dig into the snow when braking.

The invention claimed is:

1. A brake system for a wheeled riding apparatus, the riding apparatus having a deck with at least one truck coupled to a bottom of the deck through a plurality of mounting holes in the deck, and at least one wheel mounted to the truck, the brake system comprising:

a base structure having a plurality of fastener openings corresponding to at least one of the plurality of mounting holes, the base mountable on a top of the deck to the at least one truck through at least one of the plurality of mounting holes;

a brake arm having a center section and a first lateral section with a first brake surface, the center section pivotably coupled to the base structure and the first lateral section extending over a first edge of the deck such that the brake surface is positioned adjacent to at least one wheel;

a brake lever pivotally coupled to the base structure and the brake arm; and a force transmitting component coupled between the brake arm and brake lever, where the force transmitting component is resilient and compressible such that the force transmitting component maintains the brake lever in a disengaged state and application of a force to the brake lever causes the force transmitting component to transfer a portion of the force to the brake arm to move the brake surface towards the at least one wheel until the brake surface engages the at least one wheel.

2. The brake system of claim 1, were a center of the brake lever is aligned with a center of the base structure such that when affixed to the deck, the center of the brake lever is aligned with a center lengthwise axis of the deck.

3. The brake system of claim 1, where the brake arm further comprises a second lateral section with a second brake surface, where the second lateral section extends opposite to the first lateral section such that the second brake surface is positioned adjacent to at least a second wheel.

4. The brake system of claim 1, where the force transmitting component comprises a maximum compressed state, such movement of the brake lever to cause the force transmitting component to reach the maximum compressed state causes the force transmitting component to fully transfer the force applied to the brake arm.

5. The brake system of claim 1, where the brake lever and brake arm are separately pivotally coupled to the base structure.

6. The brake system of claim 5, where the brake lever and brake arm are configured such that an angular displacement of the brake lever produces an angular displacement of the brake arm, where the angular displacement of the brake arm is greater than the angular displacement of the brake lever.

7. The brake system of claim 6, further comprising a cam surface on the brake lever, where the cam surface engages the force transmitting component and amplifies a travel distance of the brake surface caused by movement of the brake lever.

8. The brake system of claim 1, fluffier comprising a spring member coupling the brake arm and the base structure to return the brake lever and brake arm to the disengaged state upon removal of the force from the brake lever.

9. The brake system of claim 1, where the brake surface contacts at least one wheel on a top front of the wheel.

10. The brake system of claim 1, where the plurality of mounting holes on the base structure are configured to match a truck mounting holes of an industry common board.

11. The brake system of claim 1, where the force transmitting structure is a compression spring.

12. The brake system of claim 11, where the compression spring comprises a variable force to apply a variable breaking force on the brake surface to the wheel, wherein the greater the compression the greater the force.

13. The brake system of claim 1, where the brake surface comprises a curved surface.

14. The brake system of claim 1, where the brake surface comprises a surface selected from the group consisting of lines, a V-shape ridge, raised bumps.

15. The brake system of claim 1, further comprising a compressible member coupled to the brake arm configured to reduce vibration of the brake arm.

16. The brake system of claim 1, further comprising a stop located on the brake arm to prevent over-rotation of the brake surface.

17. A brake system for a wheeled riding apparatus having a deck, at least one truck coupled to a bottom of the deck through a plurality of mounting holes, and at least one wheel mounted to the truck, the brake system comprising:

a base structure having a plurality of fastener openings corresponding to at least one of the plurality of mounting holes, the base structure mountable on a top of the deck to the at least one truck through at least one of the plurality of mounting holes;

a brake arm having a center section and a first lateral section with a first brake surface, the center section pivotably coupled to the base structure and the first lateral section extending over a first edge of the deck such that the brake surface is positioned adjacent to at least one wheel;

a brake lever coupled to both the base structure and the brake arm such that the brake surface is maintained in a separated state from the at least one wheel, and upon application of a force to the brake lever causes the brake lever to move the brake surface towards the at least one wheel until the brake surface engages the at least one wheel; and where the brake lever comprises at least one access opening to permit access to the fastener openings to permit disengagement of the base structure, brake arm, and brake lever from the at least one truck.

18. The brake system of claim 17, where a center of the brake lever is aligned with a center of the base structure such that when affixed to the deck, the center of the brake lever is aligned with a center lengthwise axis of the deck.

19. A wheeled riding apparatus comprising:

a deck having a top surface configured for riding by a user, a bottom surface, and a plurality of mounting holes extending through the deck;

at least one truck having at least one wheel mounted to the truck, the at least one truck located on the bottom surface of the deck;

a brake system comprising a base structure, a brake arm, and a brake lever, the base structure having a plurality of fastener openings corresponding to at least one of the plurality of mounting holes, the base mountable on the top of the deck and secured to the at least one truck, through at least one of the plurality of mounting holes;

a brake arm having a center section and a first lateral section with a first brake surface, the center section pivotably coupled to the base structure and the first lateral section extending over a first edge of the deck such that the brake surface is positioned adjacent to at least one wheel;

a brake lever pivotally coupled to the base structure and the brake arm; and a force transmitting component coupled between the brake arm and brake lever, where the force transmitting, component is resilient and compressible such that the force transmitting component maintains the brake lever in a disengaged state and application of a force to the brake lever causes the force transmitting, component to transfer a portion of the force to the brake lever to move the brake surface towards the at least one wheel until the brake surface engages the at least one wheel.

20. The apparatus of claim 19, where the at least one truck comprises a first forward truck and a second rear truck, and where the plurality of mourning holes comprises a plurality of forward mounting holes and a plurality of rear mounting holes, wherein the brake lever is substantially centered on the board deck and adapted to actuate the brake surface against at least one wheel when depressed downward toward the deck.

* * * * *